US011885549B2

(12) United States Patent
Bertolini et al.

(10) Patent No.: US 11,885,549 B2
(45) **Date of Patent: *Jan. 30, 2024**

(54) COMPACT ICE MAKING SYSTEM FOR SLIMLINE ICE COMPARTMENT

(71) Applicants: BSH Home Appliances Corporation, Irvine, CA (US); BSH Hausgeräte GmbH, Munich (DE)

(72) Inventors: Nilton Bertolini, Knoxville, TN (US); Alexander Görz, Aalen (DE); Jorge Carlos Montalvo Sanchez, Knoxville, TN (US); Vishal Vekariya, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 409 days.

This patent is subject to a terminal disclaimer.

(21) Appl. No.: 16/952,132

(22) Filed: Nov. 19, 2020

(65) Prior Publication Data

US 2021/0080165 A1 Mar. 18, 2021

Related U.S. Application Data

(63) Continuation of application No. 16/581,801, filed on Sep. 25, 2019, now Pat. No. 10,948,226, which is a continuation-in-part of application No. 15/643,601, filed on Jul. 7, 2017, now Pat. No. 10,480,842.

(51) Int. Cl.

| | |
|---|---|
| ***F25C 1/10*** | (2006.01) |
| ***F25C 5/20*** | (2018.01) |
| ***F25C 5/187*** | (2018.01) |

(52) U.S. Cl.
CPC ..... *F25C 1/10* (2013.01); *F25C 5/187* (2013.01); *F25C 5/22* (2018.01); *F25C 2400/00* (2013.01)

(58) Field of Classification Search
CPC .... F25C 1/10; F25C 2400/00; F25C 2500/02; F25C 5/187; F25C 5/22; F25D 2323/021
See application file for complete search history.

(56) References Cited

U.S. PATENT DOCUMENTS

| | | | | |
|---|---|---|---|---|
| 2,606,428 A | | 8/1952 | Oldfather | |
| 2,943,462 A | | 7/1960 | Wolferman | |
| 3,171,267 A | * | 3/1965 | Mitchell | F25C 1/12 62/352 |
| 4,685,304 A | * | 8/1987 | Essig | F25C 1/08 62/73 |

(Continued)

OTHER PUBLICATIONS

Non-Final Office Action issued in Parent U.S. Appl. No. 16/581,801 dated Oct. 7, 2020.

*Primary Examiner* — Filip Zec
(74) *Attorney, Agent, or Firm* — Michael E. Tschupp; Andre Pallapies; Brandon G. Braun

(57) ABSTRACT

A refrigerator including a fresh food compartment; a freezer compartment; an ice compartment disposed in the fresh food compartment; an ice maker disposed in the ice compartment, the ice maker including an ice maker tray, a separate fin evaporator, and a cooling tube which is assembled between the ice maker tray and the fin evaporator, such that the cooling tube is in direct contact with the ice maker tray and the fin evaporator; and an ice bucket for storing ice, the ice bucket being disposed in the ice compartment.

29 Claims, 26 Drawing Sheets

(56) References Cited

U.S. PATENT DOCUMENTS

| | | | | |
|---|---|---|---|---|
| 7,152,424 | B2 | 12/2006 | Shoukyuu et al. | |
| 7,386,992 | B2 | 6/2008 | Adamski et al. | |
| 7,406,838 | B2 | 8/2008 | Wang | |
| 8,316,661 | B2 | 11/2012 | Choi | |
| 8,375,734 | B2 | 2/2013 | Hall et al. | |
| 8,397,532 | B2 * | 3/2013 | Mitchell | F25C 1/04 62/340 |
| 8,596,084 | B2 * | 12/2013 | Herrera | F25C 5/08 62/349 |
| 8,844,310 | B2 * | 9/2014 | Chase | F25C 5/187 62/344 |
| 8,950,197 | B2 | 2/2015 | Bortoletto | |
| 9,080,799 | B2 | 7/2015 | Hong et al. | |
| 9,448,003 | B2 * | 9/2016 | Shin | F25C 1/24 |
| 9,482,458 | B2 * | 11/2016 | Jeong | F25C 5/182 |
| 2005/0150250 | A1 | 7/2005 | Allison et al. | |
| 2008/0156000 | A1 | 7/2008 | Shin et al. | |
| 2008/0295539 | A1 | 12/2008 | An et al. | |
| 2010/0218519 | A1 | 9/2010 | Hall et al. | |
| 2010/0218542 | A1 | 9/2010 | McCollough et al. | |
| 2010/0257889 | A1 | 10/2010 | Lee | |
| 2012/0324918 | A1 * | 12/2012 | Bortoletto | F25B 5/00 62/340 |
| 2016/0084560 | A1 | 3/2016 | Jeong et al. | |
| 2016/0245574 | A1 * | 8/2016 | Jeong | F25C 1/18 |
| 2016/0370052 | A1 | 12/2016 | Yang | |

* cited by examiner

COMPACT ICE MAKING SYSTEM FOR SLIMLINE ICE COMPARTMENT

CROSS-REFERENCE TO RELATED APPLICATIONS

The present application is a continuation of U.S. patent application Ser. No. 16/581,801, filed on Sep. 25, 2019, which is a continuation-in-part of U.S. patent application Ser. No. 15/643,601, filed on Jul. 7, 2017, which issued as U.S. Pat. No. 10,480,842 on Nov. 19, 2019, the contents of all of which are herein incorporated by reference in their entirety.

FIELD OF THE INVENTION

The present disclosure relates generally to a refrigerator appliance and to an ice making system disposed in a dedicated ice compartment of the refrigerator appliance. More particularly, the present disclosure relates to a compact ice making system for use in a slimline ice compartment having a side-by-side ice maker and ice bucket.

BACKGROUND OF THE INVENTION

In general, refrigerator appliances, such as for household use, typically have a bulky ice compartment for making and storing ice located within the fresh food compartment. The ice compartment assembly has an over-under arrangement where the ice maker is positioned on top and the ice bucket is located underneath the ice maker within the ice compartment.

SUMMARY OF THE INVENTION

On the other hand, making the ice compartment and bucket larger especially in the vertical height direction takes up too much volume in the fresh food compartment, thereby making it less desirable to customers/users. In this regard, customers/users want to maximize the volume of the fresh food compartment for the storage of fresh food items. Making the ice compartment taller also limits a design to be used only on taller doors (for example, it would not be usable in models with more than 1 drawer and two doors), and/or require the ice and water dispenser to be positioned at a lower position which is not ergonomically optimum for customers/users.

An apparatus consistent with the present disclosure is directed to a self-contained, dedicated compartment for producing and storing ice, without using cold air that is produced outside of the ice compartment and then ducted to and from the ice compartment.

An apparatus consistent with the present disclosure is directed to a slimline ice compartment which takes up less volume in the fresh food compartment and results in faster ice production.

An apparatus consistent with the present disclosure results in a significant reduction of the internal volume that the ice compartment takes up inside the fresh food compartment, as it combines an ice tray and an evaporator into a single piece with the bottom of the ice maker (a metallic tray portion) also acting as an evaporator for the ice compartment. This in turn eliminates the need for an additional evaporator to cool the air inside the insulated ice compartment.

An apparatus consistent with the present disclosure results in a much higher ice production, as the evaporator cooling tube is in direct contact with the ice maker tray portion of the ice maker tray/evaporator, and this in turn reduces the time to fill the ice bucket. In particular, the ice maker tray/evaporator of the present disclosure freezes the water in the mold cavities very fast, since the ice maker tray portion temperature runs as cold as the refrigerant is evaporated.

An apparatus consistent with the present disclosure is directed to a slimline ice compartment having a side-by-side ice maker and ice bucket.

According to one aspect, the present disclosure provides a refrigerator including a fresh food compartment; a freezer compartment; an ice compartment disposed in the fresh food compartment; an ice maker assembly disposed in the ice compartment, the ice maker assembly including an ice maker tray/evaporator having an evaporator cooling tube which is die cast over-molded inside an ice maker tray portion to form a one piece unit, such that the evaporator cooling tube is in direct contact with the ice maker tray portion; and an ice bucket for storing ice, the ice bucket being disposed in the ice compartment.

According to another aspect, the ice maker assembly and the ice bucket are arranged side-by-side in a horizontal direction within the ice compartment.

According to another aspect, no portion of the ice bucket is located below the ice maker when the ice maker is projected downward in a vertical height direction.

According to another aspect, the ice compartment is disposed in an upper corner of the fresh food compartment.

According to another aspect, the refrigerator is a French door-bottom mount configuration having the fresh food compartment on top and the freezer compartment below the fresh food compartment.

According to another aspect, the ice compartment is disposed in an upper left hand corner of the fresh food compartment.

According to another aspect, the ice bucket is removably mounted in the ice compartment.

According to another aspect, the ice compartment has a thin dimension in a vertical height direction H of approximately 5.6 inches±2.0 inches, and wherein the ice compartment has a horizontal width W of approximately 10.4 inches±2.0 inches.

According to another aspect, the ice bucket has a front cover, and the front cover has an opening in a bottom portion for discharging pieces of ice.

According to another aspect, the fresh food compartment includes a door, and further comprising an ice chute for an ice dispenser and being disposed in the door, the ice chute being configured to communicate with the opening in the front cover via an ice chute extension.

According to another aspect, the evaporator cooling tube is formed of at least one of copper or a copper alloy.

According to another aspect, the ice maker tray portion is formed of at least one of aluminum or an aluminum alloy.

According to another aspect, a bottom portion of the ice maker tray/evaporator includes evaporator fins which extend downward substantially vertically.

According to another aspect, an air handler/auger motor assembly is disposed at a rear portion of the ice compartment behind the ice bucket.

According to another aspect, the air handler/auger motor assembly comprises an air duct having a motor driven fan disposed therein, wherein an inlet of the motor driven fan communicates with an airflow passage under the ice maker tray/evaporator, such that the motor driven fan creates a suction and draws cool air from the ice maker tray/evaporator and discharges the cool air through the air duct and to the ice bucket to prevent any ice pieces in the ice bucket from melting.

According to another aspect, the air duct is located at an upper portion of the air handler/auger motor assembly.

According to another aspect, the present disclosure provides a refrigerator comprising: a refrigerator compartment; a freezer compartment; an ice compartment disposed in the refrigerator compartment; an ice maker disposed in the ice compartment; and an ice bucket for storing ice, the ice bucket being disposed in the ice compartment, the ice bucket being removably mounted in the ice compartment, and the ice bucket having a front cover with an opening in a bottom portion for discharging pieces of ice; and a cube/crush DC motor and reed switch assembly including a cube/crush DC motor and a reed switch and being disposed in the ice compartment at a location in front of the ice maker and being configured to control whether cubed or crushed ice is delivered to the opening in the front cover, wherein the ice bucket has a magnet that interfaces with the reed switch, such that on condition that the ice bucket with front cover is removed from the ice compartment, the reed switch disables the ice maker.

According to another aspect, the opening has an ice gate that pivots, such that the ice gate opens or closes, and wherein the pivoting of the ice gate is carried out by a rod that is controlled by the cube/crush DC motor.

According to another aspect, the cube/crush DC motor comprises a 12 volt DC reversible electric motor.

According to another aspect, the present disclosure provides an ice maker assembly for use in an ice compartment of a refrigerator, the ice maker assembly comprising: an ice maker tray/evaporator having an evaporator cooling tube which is die cast over-molded inside an ice maker tray portion to form a one piece unit, such that the evaporator cooling tube is in direct contact with the ice maker tray portion.

According to another aspect, the present disclosure provides a refrigerator comprising: a fresh food compartment; a freezer compartment; an ice compartment disposed in the fresh food compartment; an ice maker disposed in the ice compartment, the ice maker including an ice maker tray, a separate fin evaporator, and a cooling tube which is assembled between the ice maker tray and the fin evaporator, such that the cooling tube is in direct contact with the ice maker tray and the fin evaporator; and an ice bucket for storing ice, the ice bucket being disposed in the ice compartment.

According to another aspect, an ice compartment air duct member is provided that communicates with an outlet of an air duct and is configured to direct and distribute the cool air over the ice pieces in the ice bucket.

According to another aspect, the ice bucket is removably mounted in the ice compartment, and the ice bucket has a front cover with an opening in a bottom portion for discharging pieces of ice; and further comprising: a cube/crush motor assembly including a cube/crush motor and a Hall effect switch and being disposed in the ice compartment at a location in front of the ice maker and being configured to control whether cubed or crushed ice is delivered to the opening in the front cover, wherein the ice bucket has a magnet that interfaces with the Hall effect switch, such that on condition that the ice bucket with front cover is removed from the ice compartment, the Hall effect switch disables the ice maker.

According to another aspect, a drain assembly is positioned under the fin evaporator, wherein the ice bucket is arranged side-by-side with the ice maker and the drain assembly in a horizontal direction within the ice compartment, such that a bottom portion of the ice bucket is located at substantially the same level as a bottom portion of the drain assembly in a vertical height direction.

According to another aspect, the drain assembly cooperates with a bottom portion of the fin evaporator to form an airflow passage under the ice maker and through evaporator fins of the fin evaporator.

According to another aspect, the drain assembly comprises a drain housing, drain insulation, and a drain plate.

According to another aspect, a heater plate and an extender housing are attached at a rear end of the drain assembly.

According to another aspect, the heater plate is formed of aluminum.

According to another aspect, the heater plate and the extender housing transfer heat from a defrost heater into a drain hole.

According to another aspect, an inner side wall of the ice bucket is formed with a recessed portion across a bottom front of the ice bucket in order to facilitate air flow into a front end portion of the airflow passage.

According to another aspect, a bottom of the front cover includes at least one gripper recess for a user to insert their fingers to pull and remove the ice bucket.

According to another aspect, the present disclosure provides an ice maker assembly for use in an ice compartment of a refrigerator, the ice maker assembly including an ice maker tray portion, a separate fin evaporator portion, and a cooling tube which is assembled between the ice maker tray portion and the fin evaporator portion, such that the cooling tube is in direct contact with the ice maker tray portion and the fin evaporator.

According to another aspect, the present disclosure provides a refrigerator comprising: a fresh food compartment; a freezer compartment; an ice compartment disposed in the fresh food compartment; an ice maker disposed in the ice compartment, the ice maker including an ice maker tray, an evaporator, and a cooling tube which is disposed between the ice maker tray and the evaporator, such that the cooling tube is in direct contact with the ice maker tray and the evaporator; and an ice bucket for storing ice, the ice bucket being disposed in the ice compartment, wherein the ice maker and the ice bucket are arranged side-by-side in a horizontal direction within the ice compartment, and wherein no portion of the ice bucket is located below the ice maker when the ice maker is projected downward in a vertical height direction.

According to another aspect, the present disclosure provides a refrigerator comprising: a fresh food compartment; a freezer compartment; an ice compartment disposed in the fresh food compartment; an ice maker disposed in the ice compartment, the ice maker including an ice maker tray, an evaporator, and a cooling tube which is disposed between the ice maker tray and the evaporator, such that the cooling tube is in direct contact with the ice maker tray and the evaporator; a drain assembly positioned under the evaporator; and an ice bucket for storing ice, the ice bucket being disposed in the ice compartment, wherein the ice bucket is arranged side-by-side with the ice maker and the drain assembly in a horizontal direction within the ice compartment, such that a bottom portion of the ice bucket is located at substantially the same level as a bottom portion of the drain assembly in a vertical height direction.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 7B:
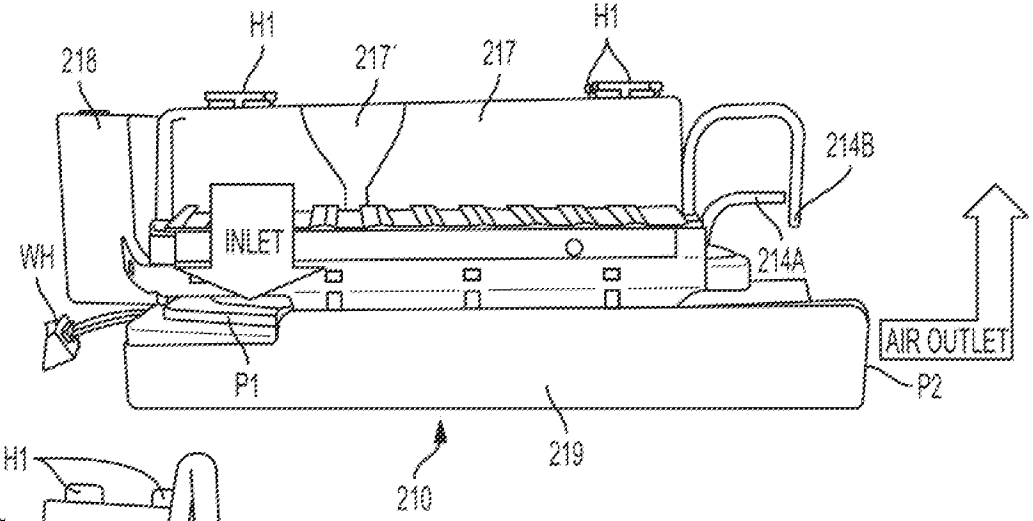
Figure 7C:
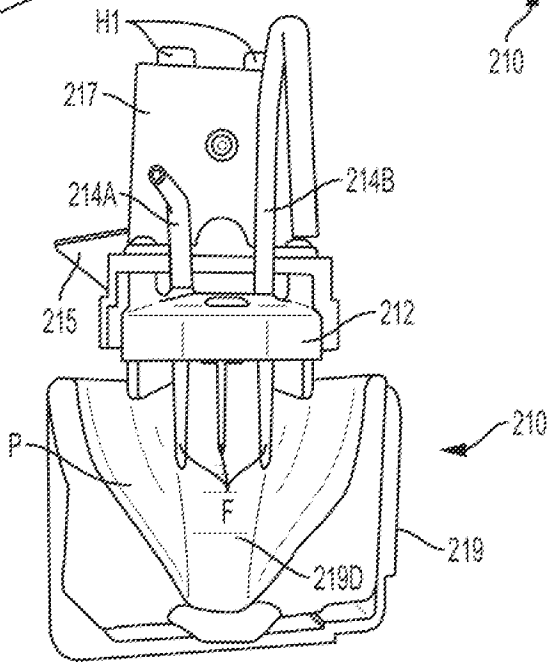
Figure 7A:
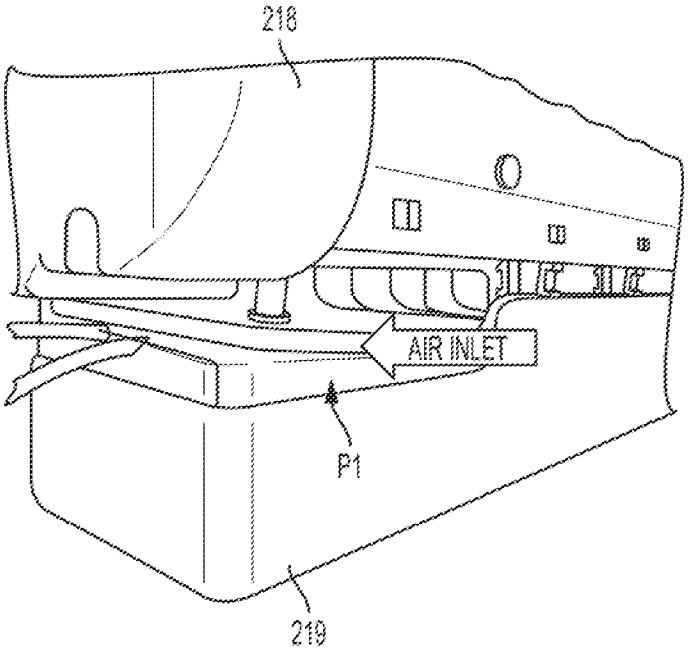
Figure 8B:
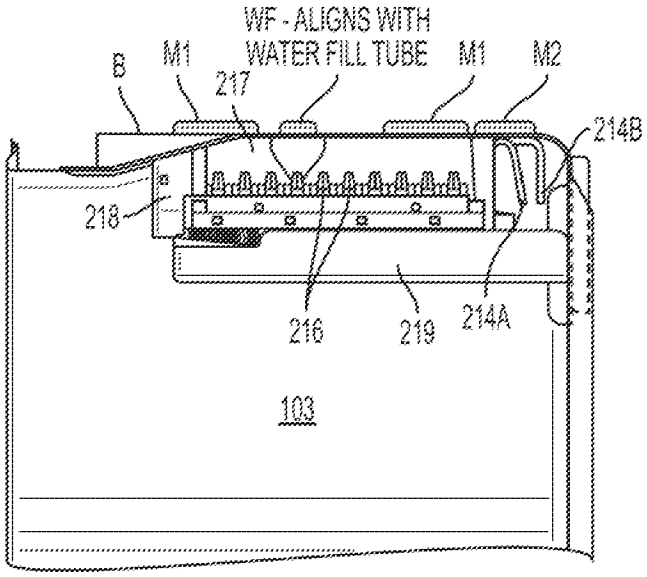
Figure 8C:
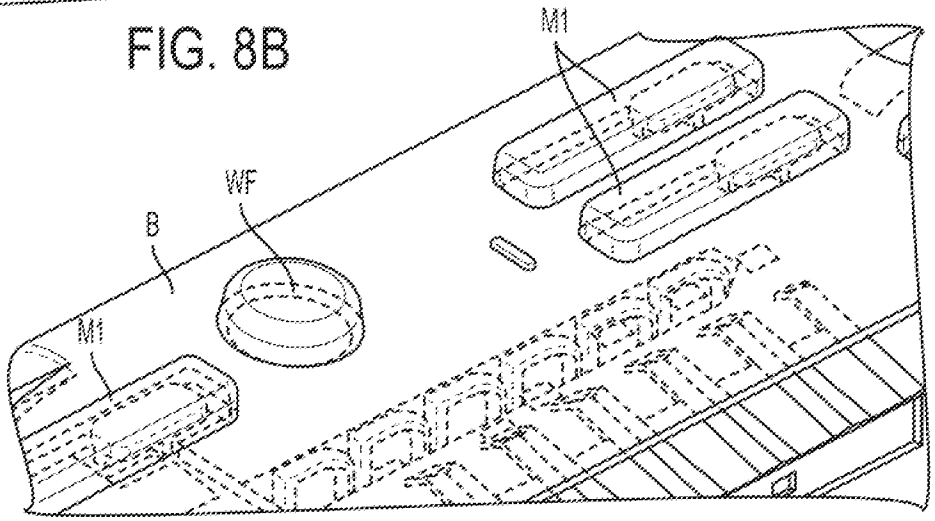
Figure 8A:
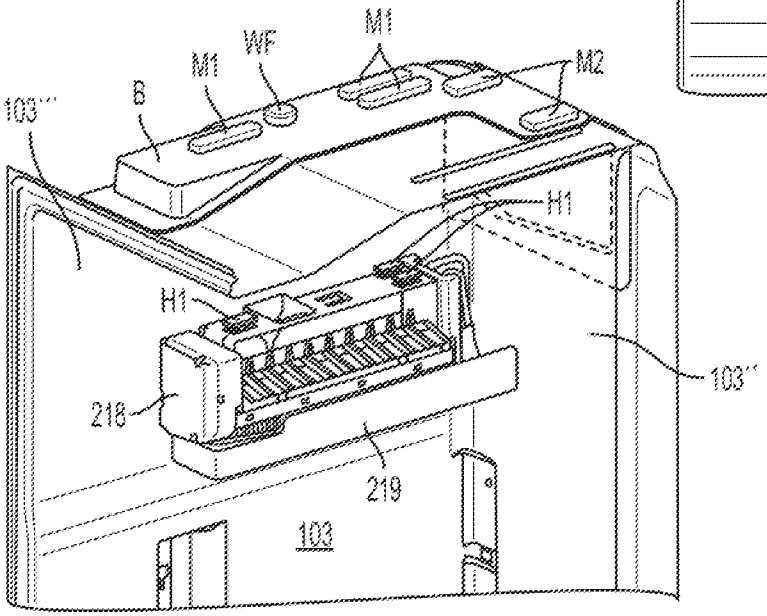
Figure 9A:
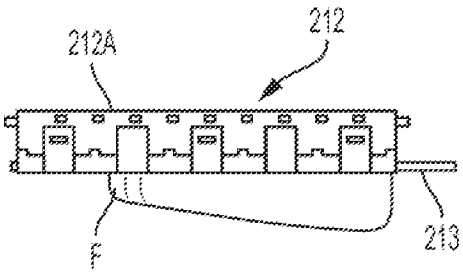
Figure 9B:
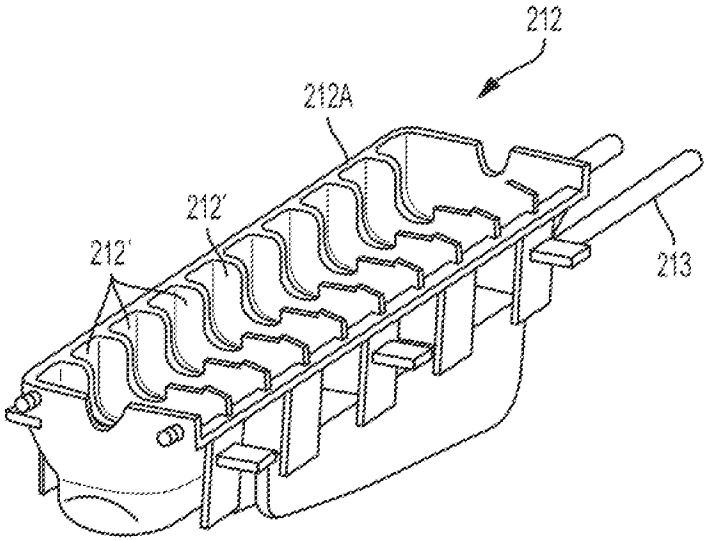
Figure 9C:
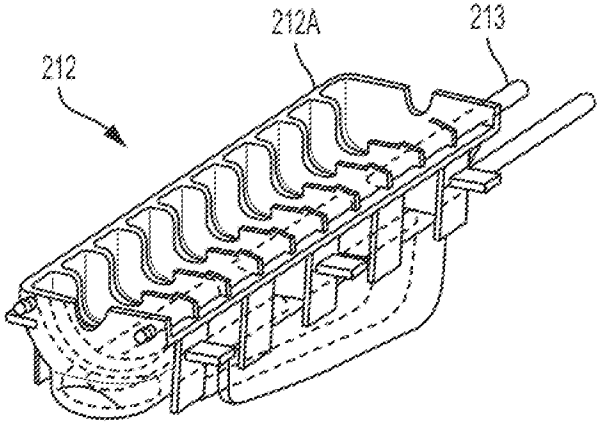
Figure 10:
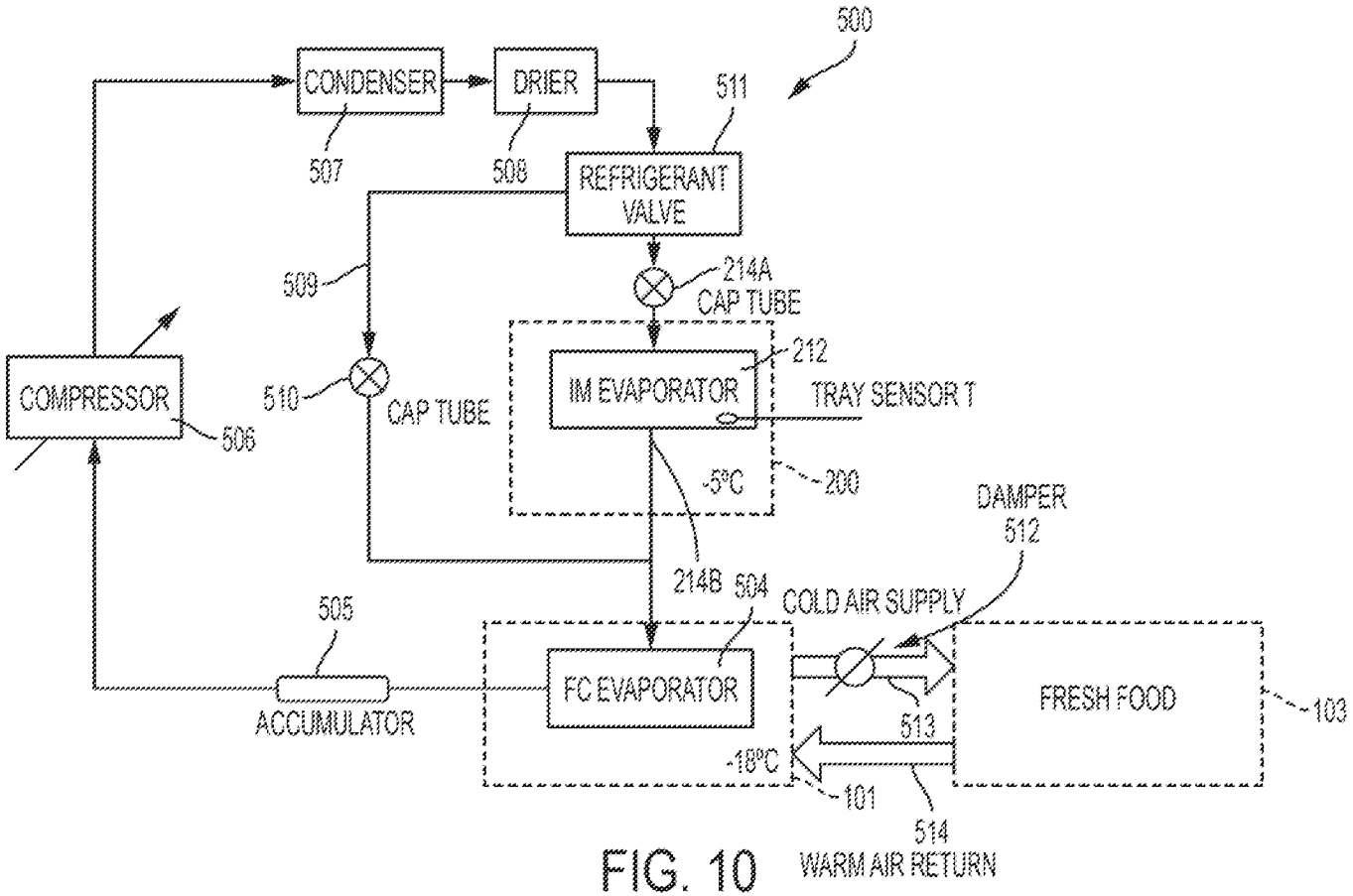
Figure 11:
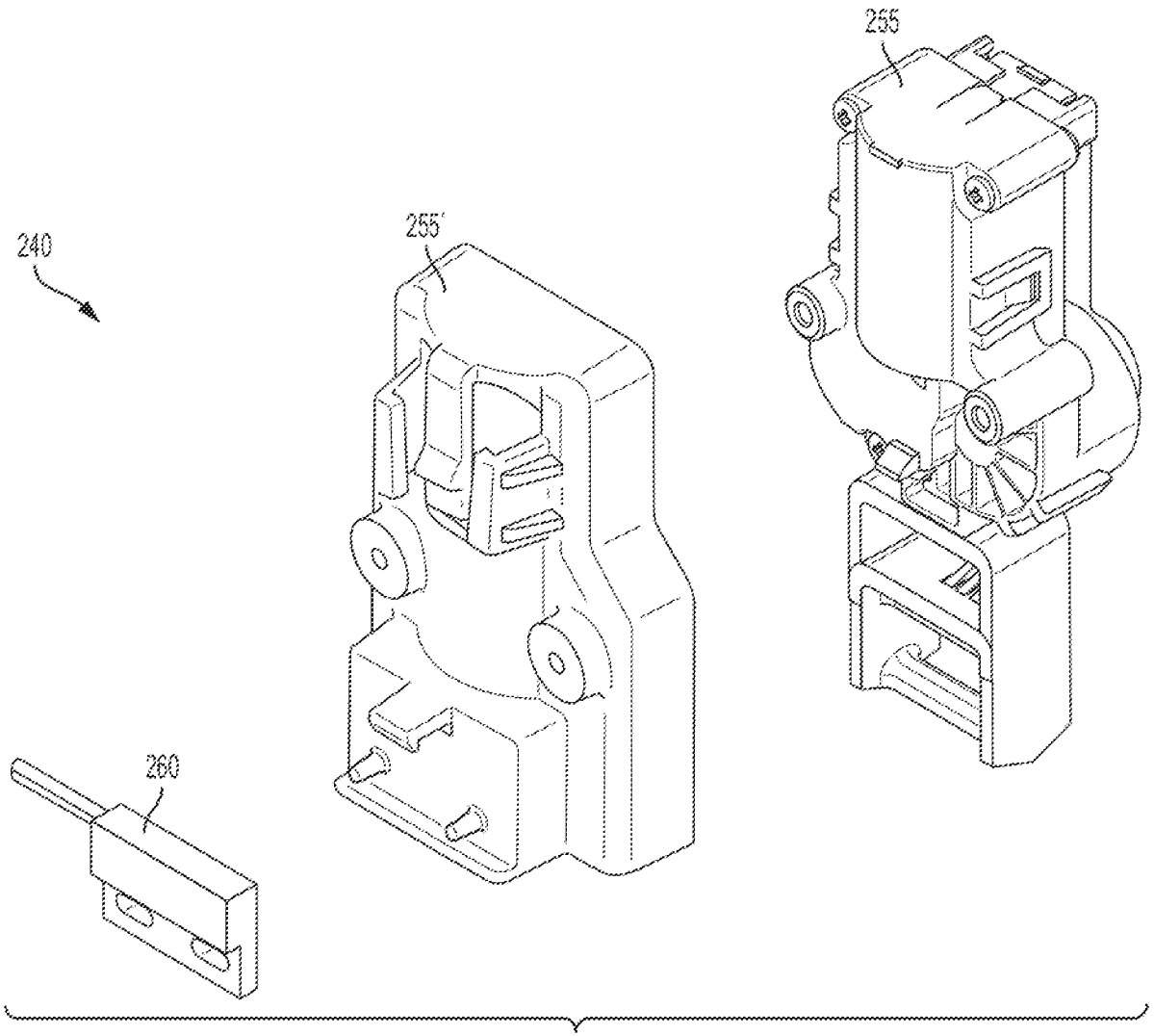
Figure 13:
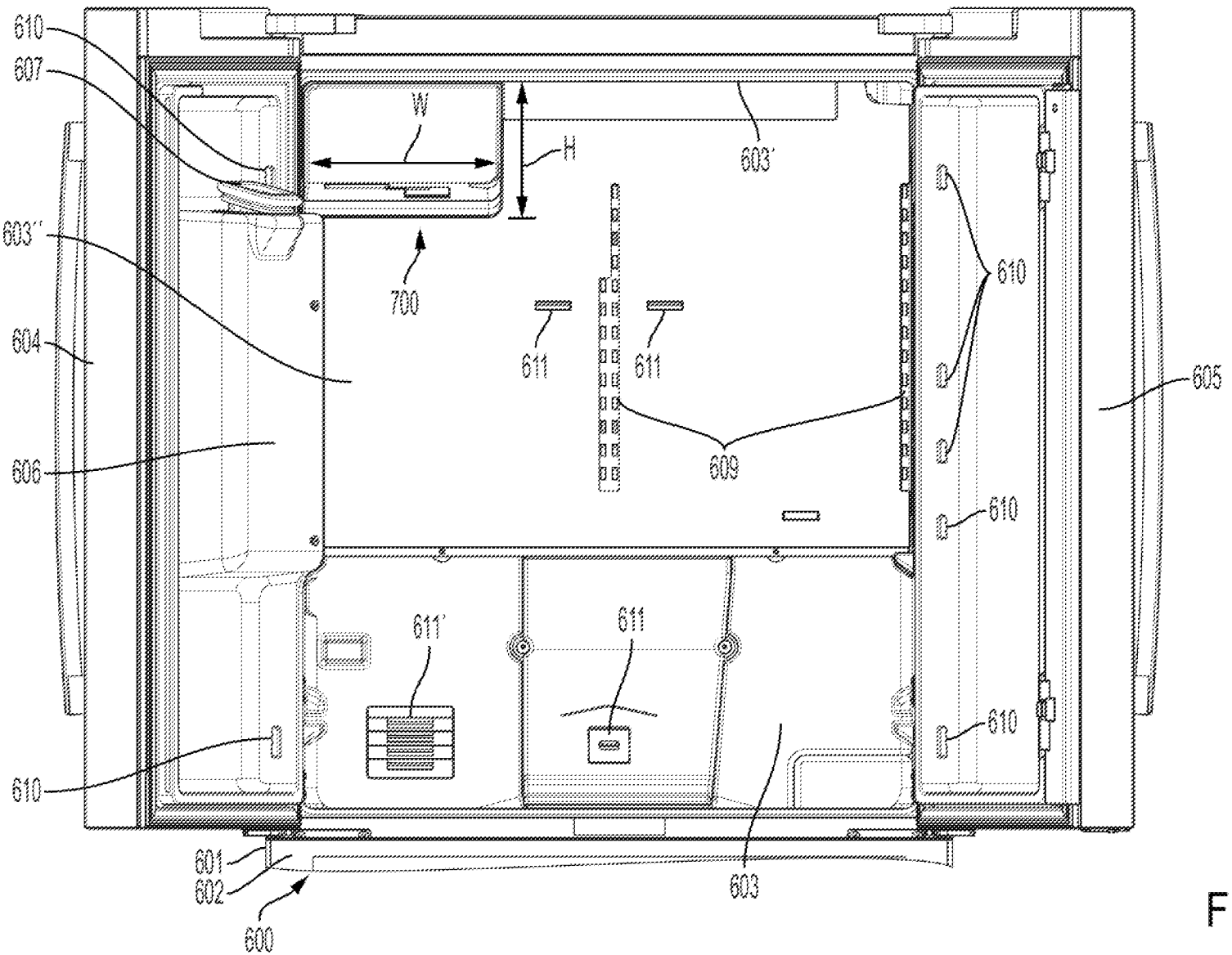
Figure 14:
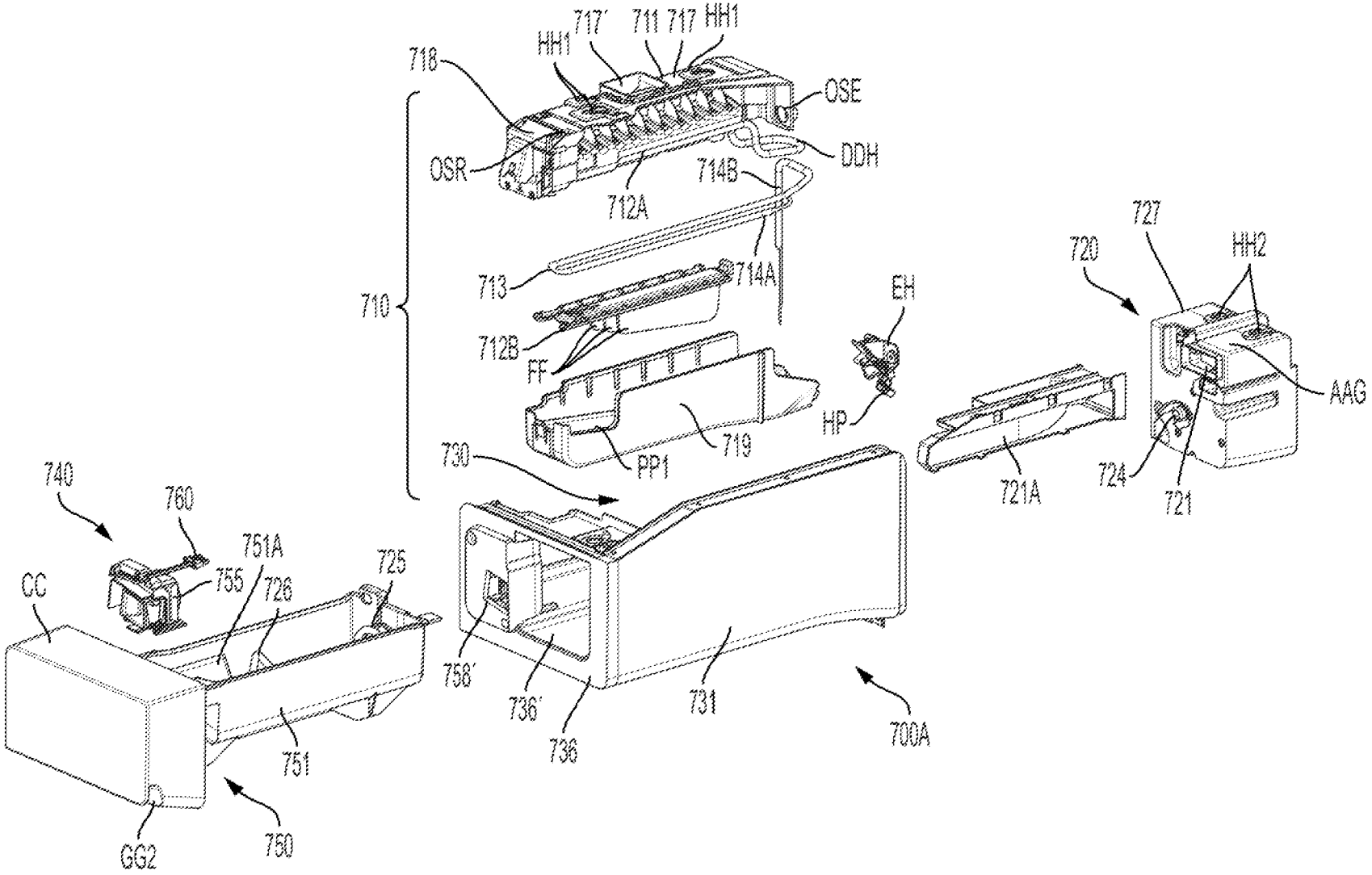
Figure 15A:
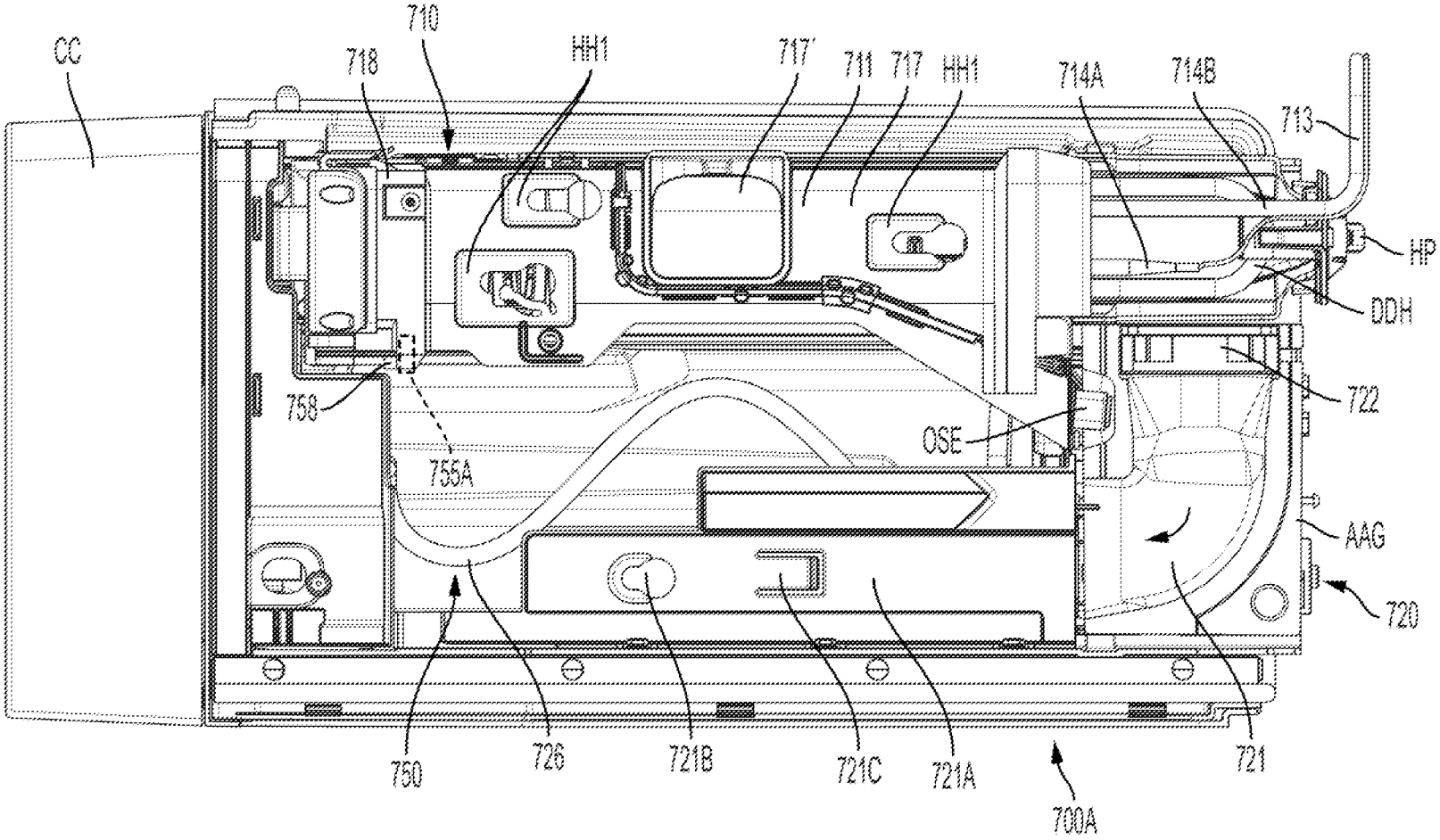
Figure 15B:
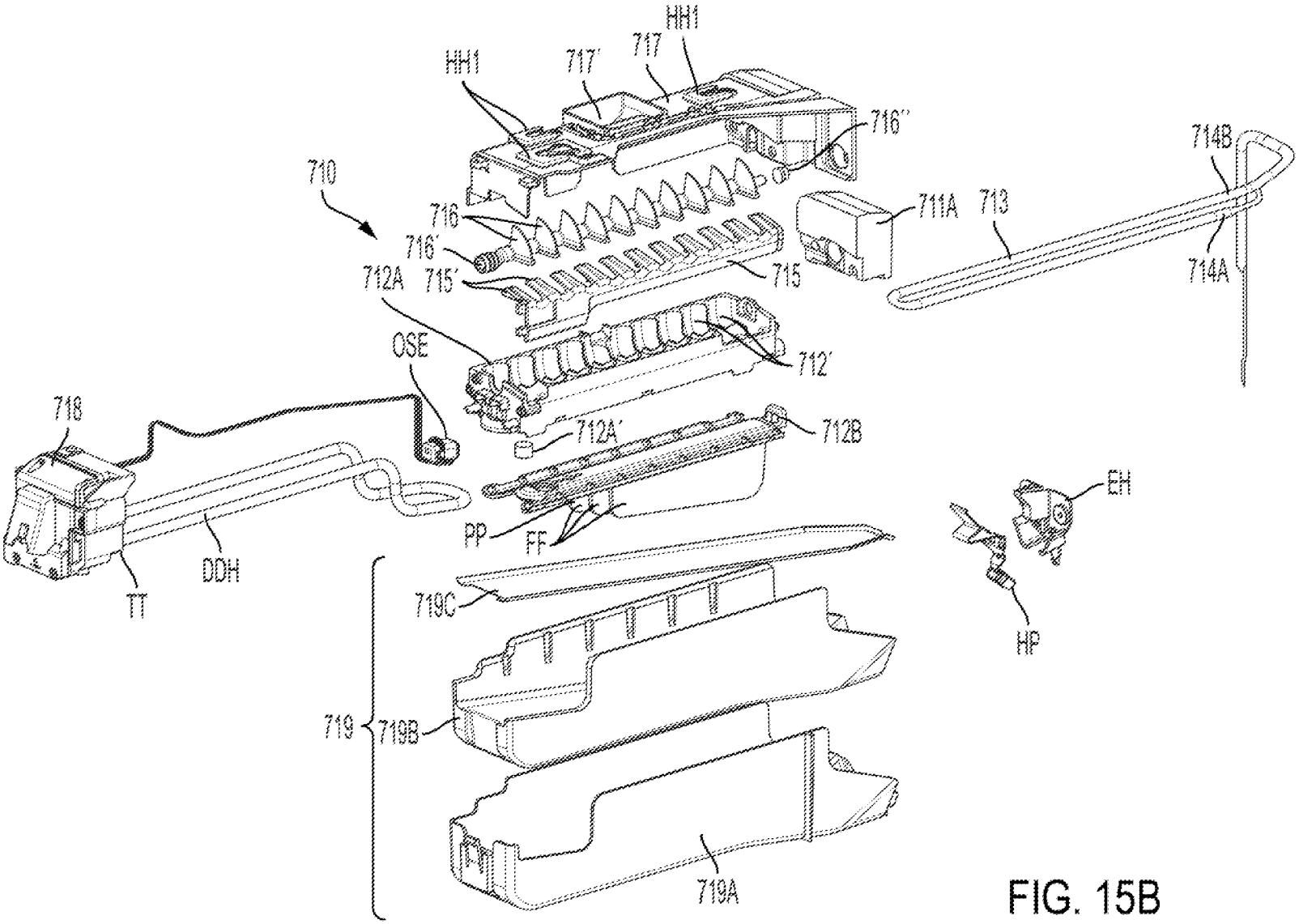
Figure 16B:
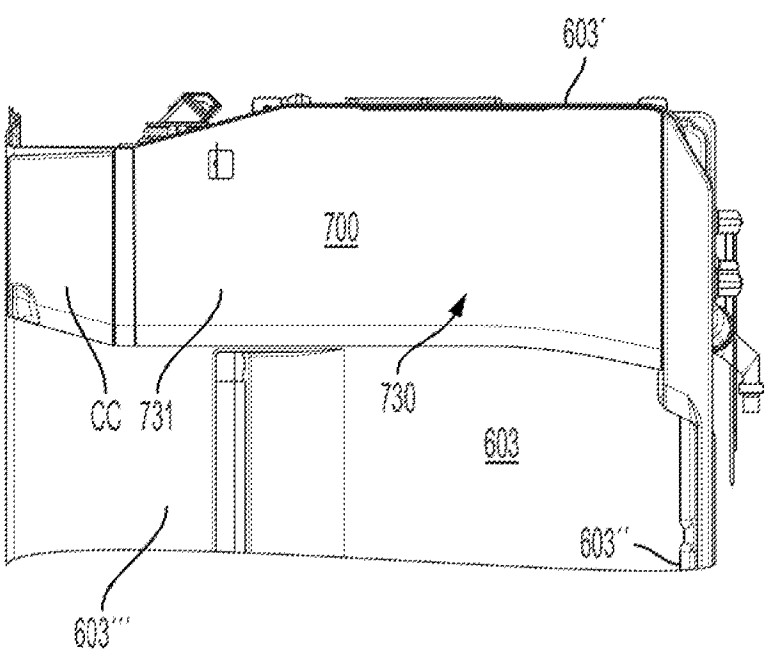
Figure 16A:
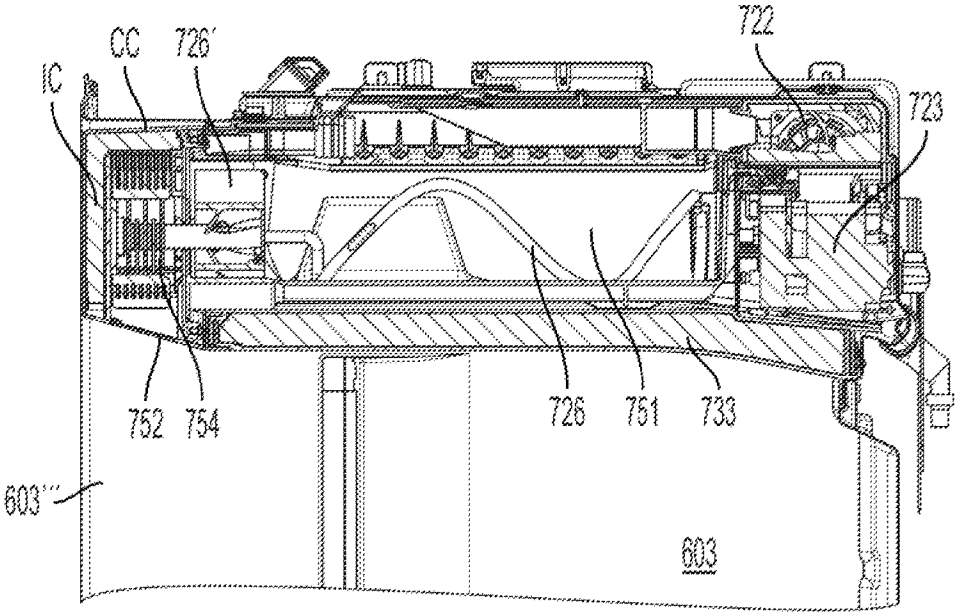
Figure 16C:
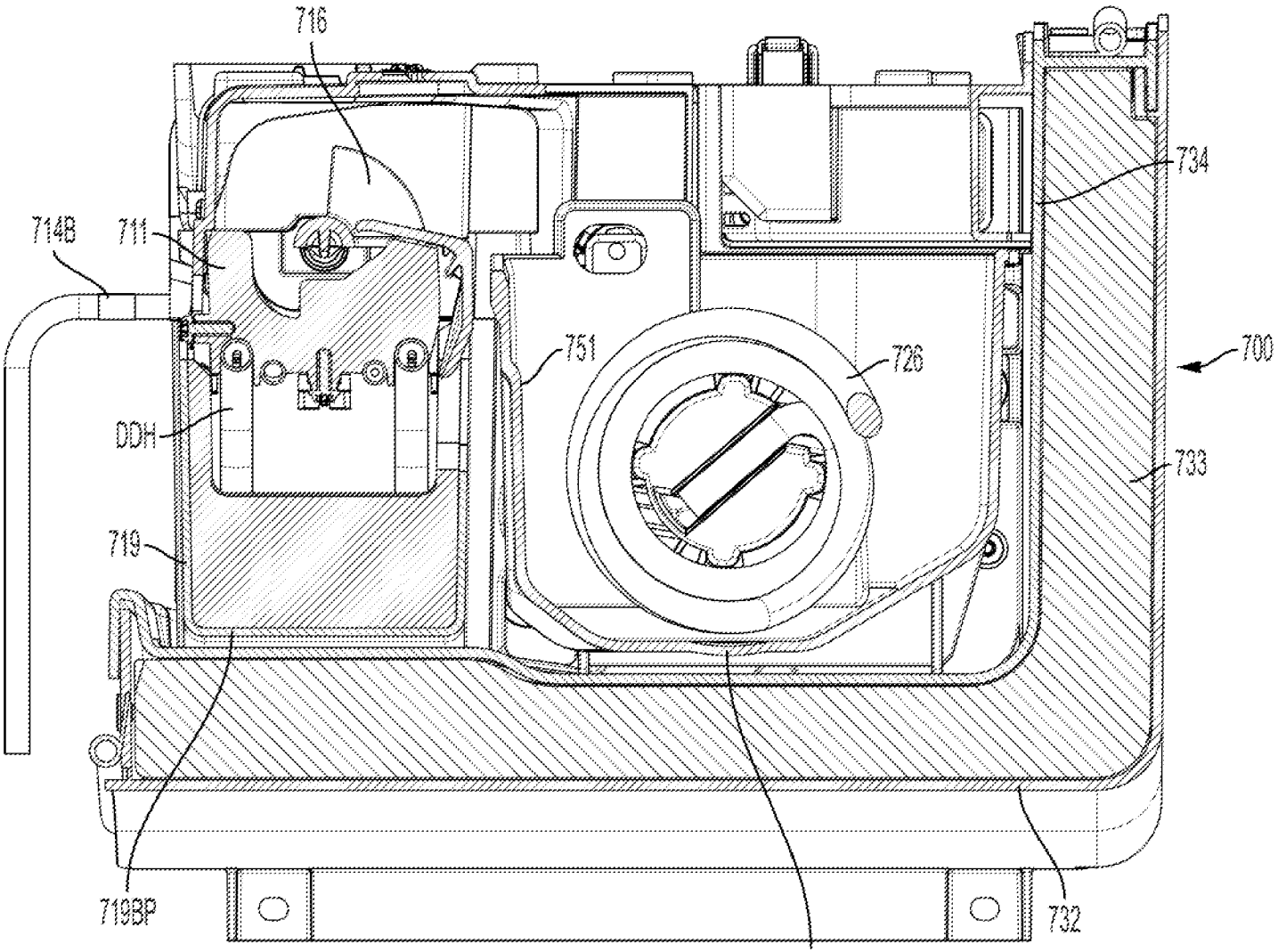
Figure 17:
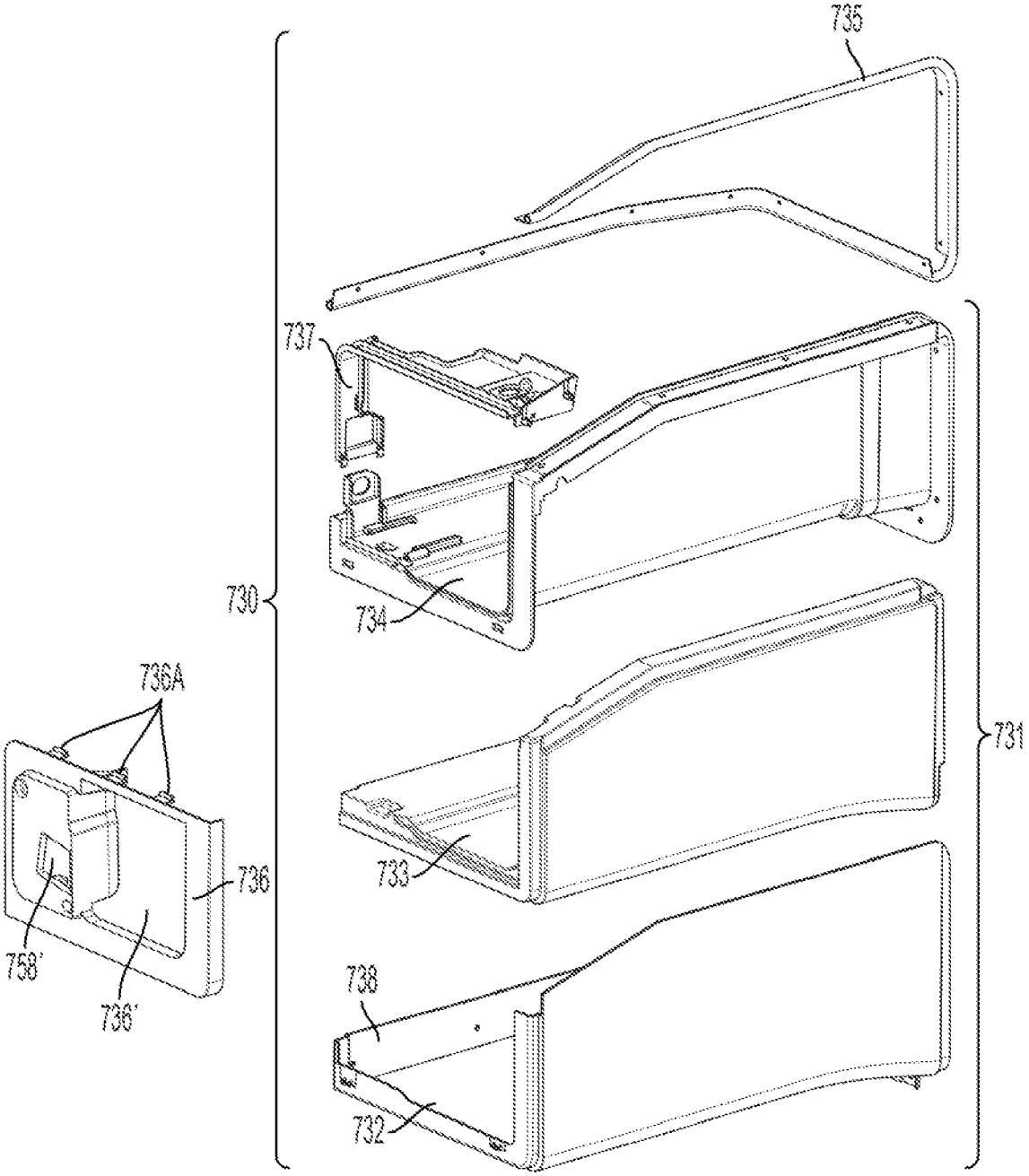
Figure 18:
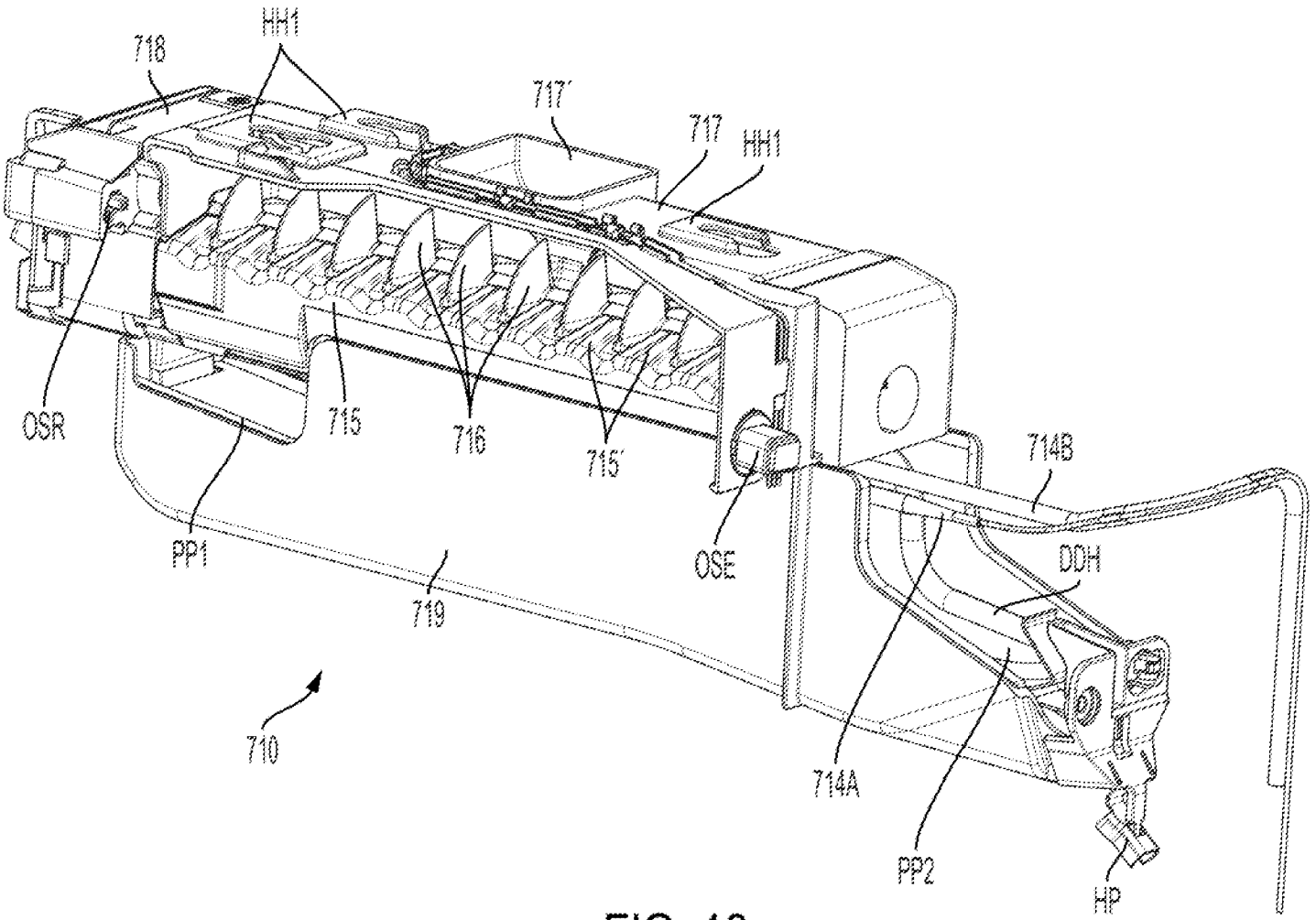
Figure 19B:
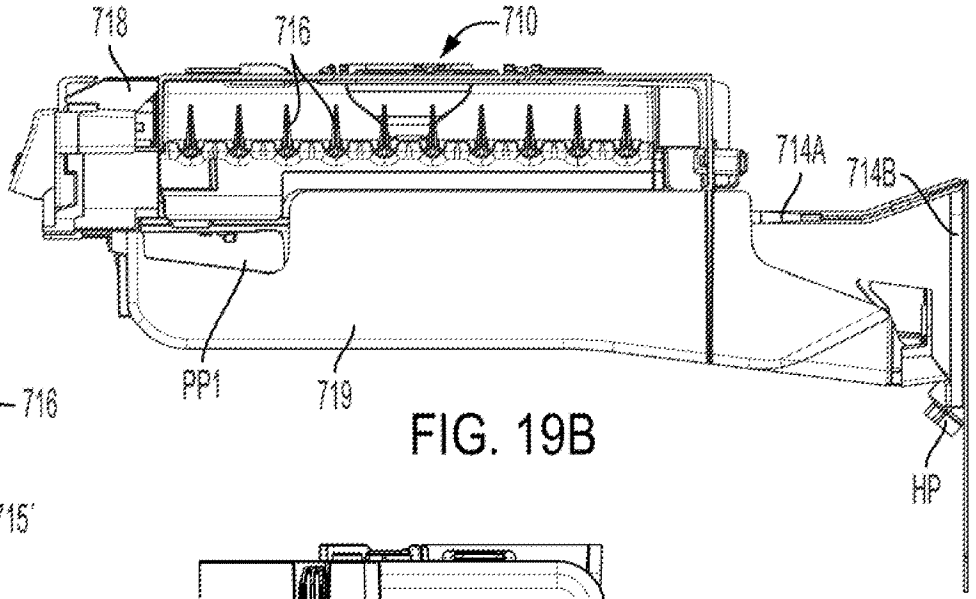
Figure 19C:
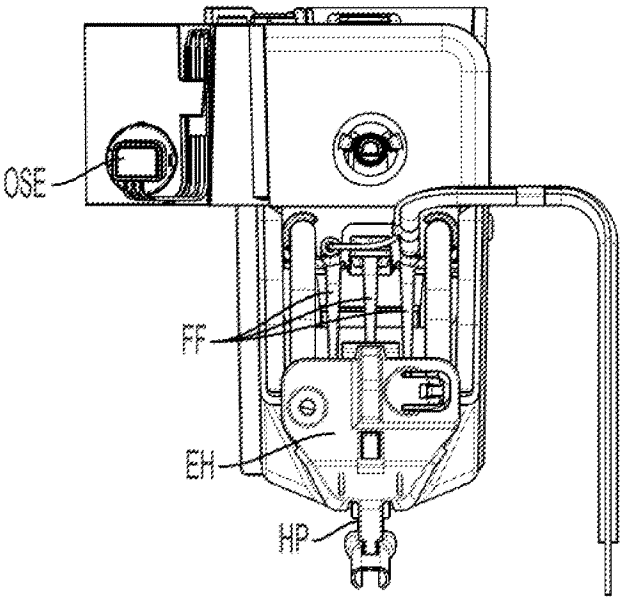
Figure 19A:
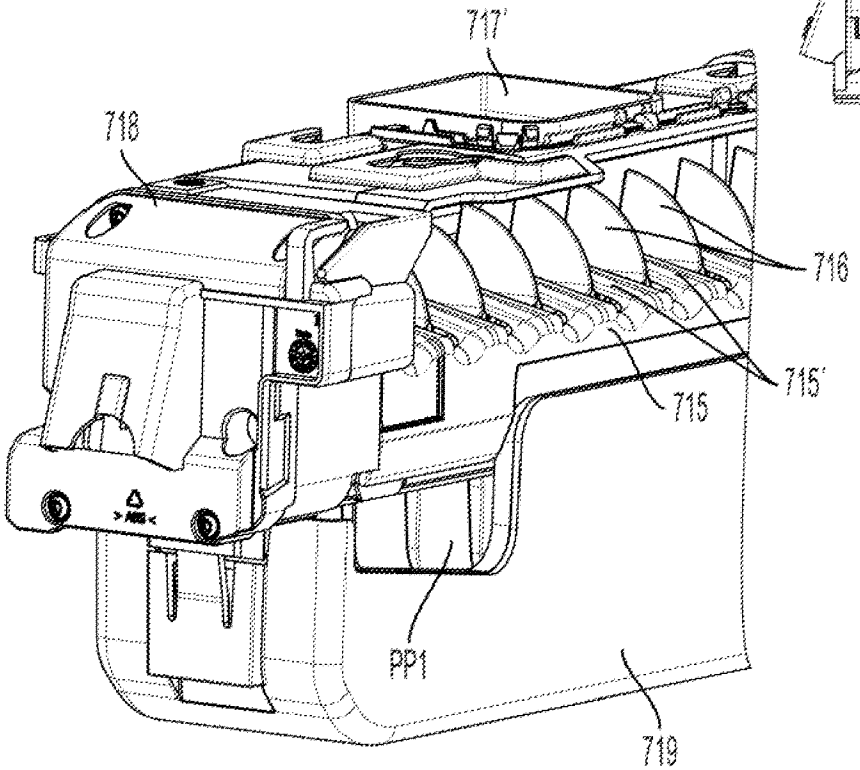
Figure 20B:
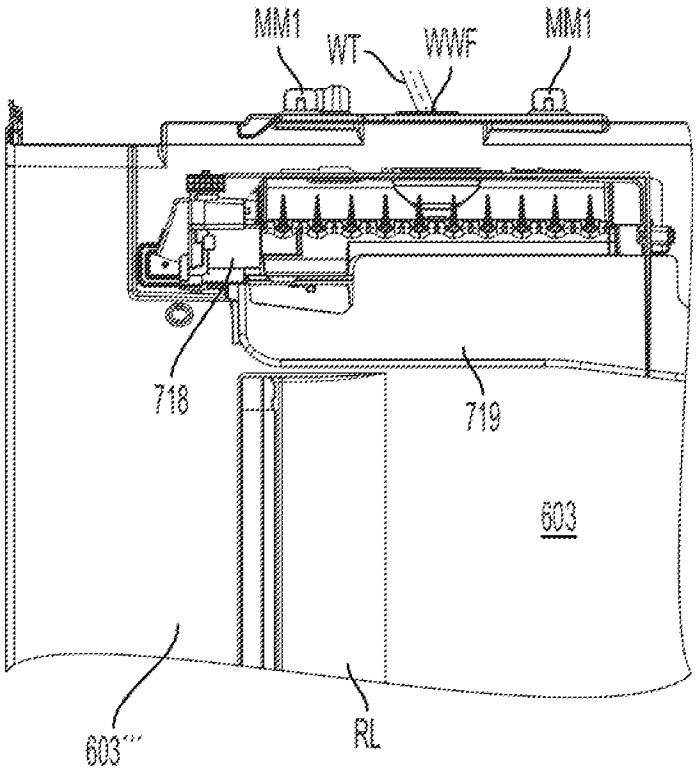
Figure 20A:
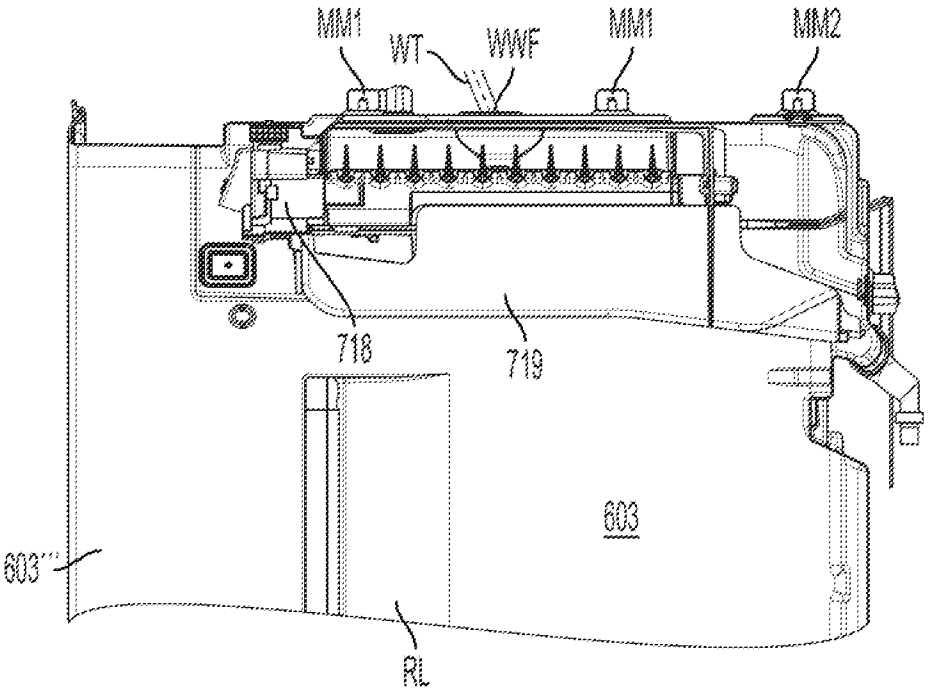
Figure 21A:
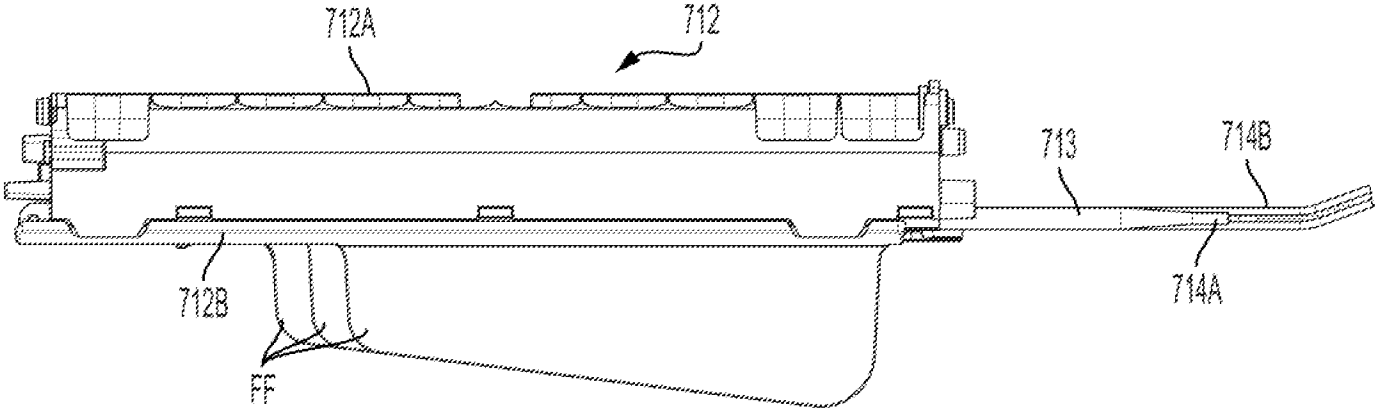
Figure 21C:
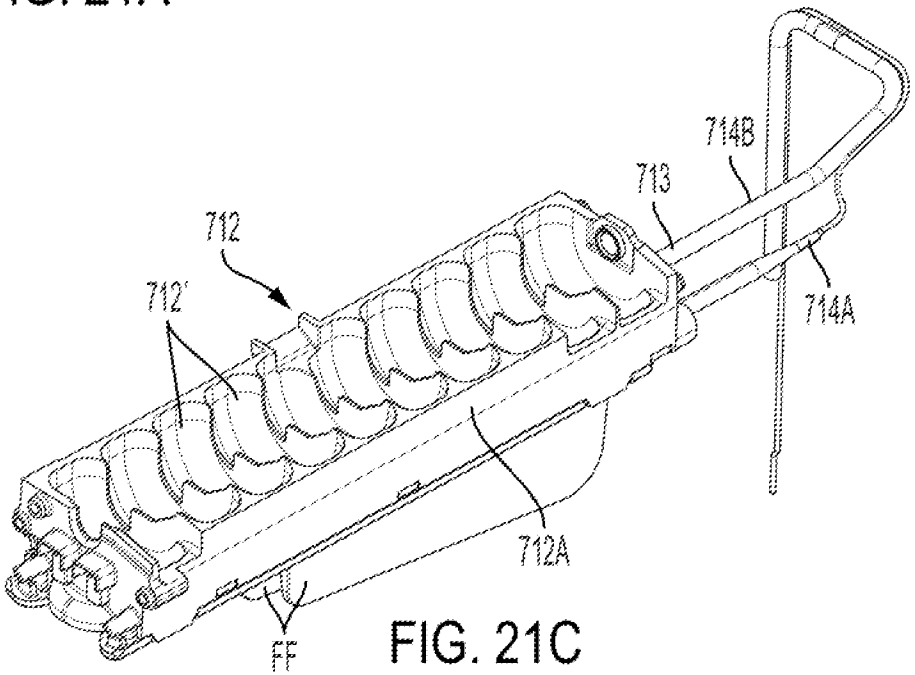
Figure 21B:
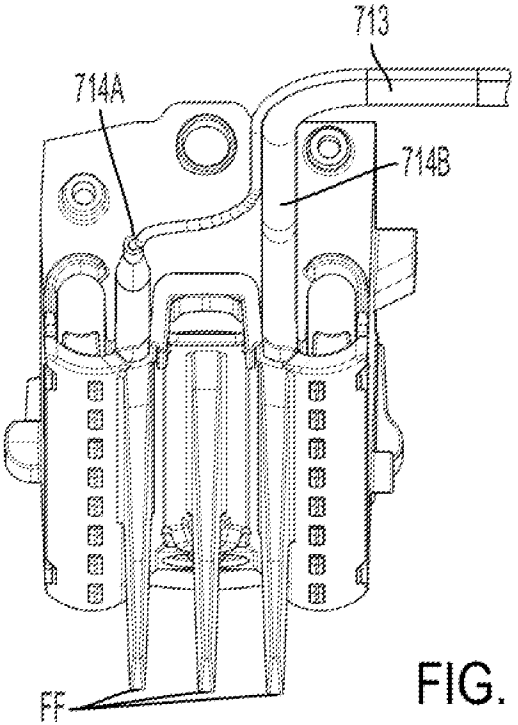
Figure 22B:
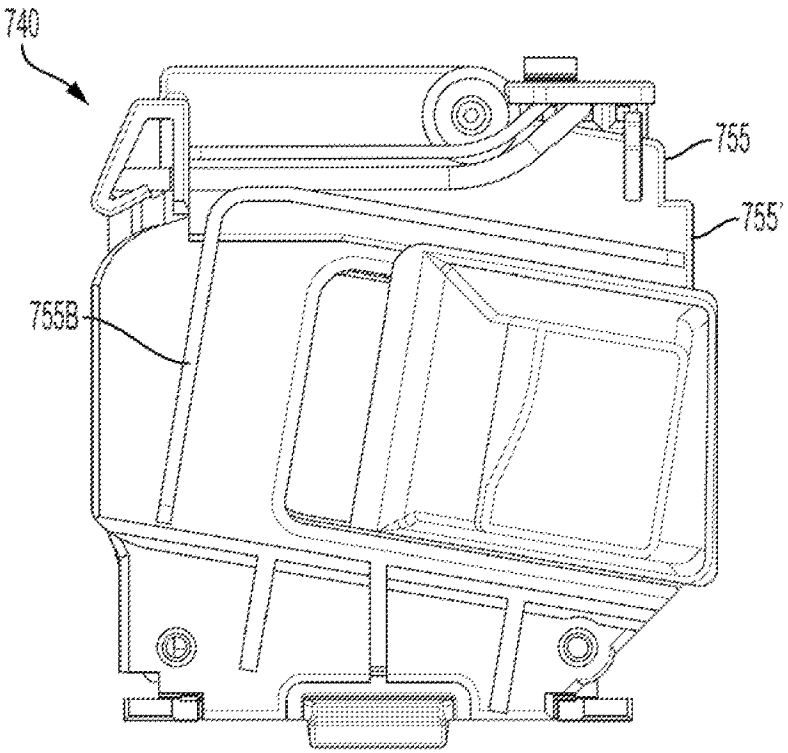
Figure 22A:
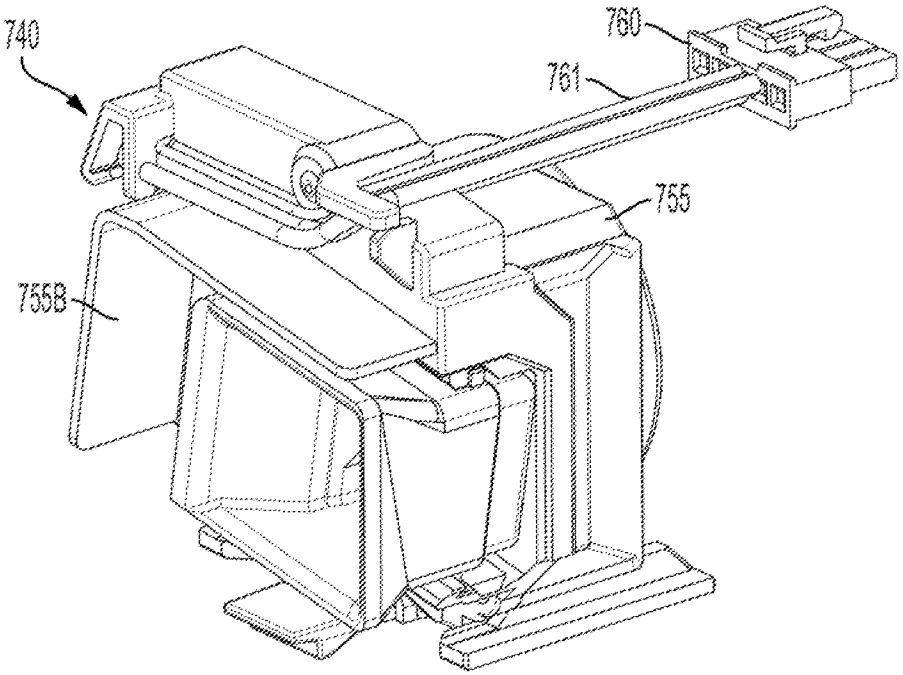

FIGS. 7A, 7B, and 7C are various perspective views of the ice maker assembly showing the air flow and the evaporator fins according to the first exemplary embodiment consistent with present disclosure;

FIGS. 8A, 8B, and 8C are various views of the ice maker assembly being mounted to the foamed-in bracket according to the first exemplary embodiment consistent with present disclosure;

FIGS. 9A, 9B, and 9C are various views showing a one-piece over-molded solution for configuring the ice maker tray/evaporator according to the first exemplary embodiment consistent with present disclosure;

FIG. 10 shows a freezer compartment/icemaker refrigerant circuit according to the first exemplary embodiment consistent with present disclosure;

FIG. 11 shows an exploded perspective view of the cube/crush DC motor and reed switch assembly according to the first exemplary embodiment consistent with present disclosure;

FIGS. 12A, 12B, 12C, and 12D showing various views of ice bucket and ice gate assembly according to the first exemplary embodiment consistent with present disclosure;

FIG. 13 illustrates a fragmentary front view of a French door-bottom mount style refrigerator with the doors open to reveal the slimline ice compartment according to a second exemplary embodiment consistent with present disclosure;

FIG. 14 is an exploded perspective view of the complete ice maker/ice bucket/ice compartment assembly according to the second exemplary embodiment of FIG. 13 consistent with present disclosure;

FIG. 15A is a top view of the complete ice maker/ice bucket/ice compartment assembly according to the second exemplary embodiment of FIG. 13 consistent with present disclosure;

FIG. 15B is an exploded perspective view of the ice maker assembly according to the second exemplary embodiment of FIG. 13 consistent with present disclosure;

FIG. 16A is a fragmentary cutaway side elevational view showing the complete ice maker/ice bucket/ice compartment assembly according to the second exemplary embodiment of FIG. 13 consistent with present disclosure;

FIG. 16B is a fragmentary side elevational view showing the exterior of the ice compartment inside the refrigerator compartment according to the second exemplary embodiment of FIG. 13 consistent with present disclosure;

FIG. 16C is a cross-sectional view showing the ice bucket arranged side-by-side with the ice maker and the drain assembly in the slimline ice compartment according to the second exemplary embodiment of FIG. 13 consistent with present disclosure;

FIG. 17 is an exploded perspective view of an L-shaped ice compartment assembly according to the second exemplary embodiment of FIG. 13 consistent with present disclosure;

FIG. 18 is a perspective view of the ice maker assembly according to the second exemplary embodiment of FIG. 13 consistent with present disclosure;

FIGS. 19A, 19B, and 19C are various views of the ice maker assembly according to the second exemplary embodiment of FIG. 13 consistent with present disclosure;

FIGS. 20A and 20B are various side views of the ice maker assembly being mounted to the foamed-in bracket according to the second exemplary embodiment of FIG. 13 consistent with present disclosure;

FIGS. 21A, 21B, and 21C are various views showing the ice maker tray, fin evaporator, and cooling tube assembly according to the second exemplary embodiment of FIG. 13 consistent with present disclosure;

FIGS. 22A and 22B show various views of the cube/crush motor assembly according to the second exemplary embodiment of FIG. 13 consistent with present disclosure; and FIGS. 23A, 23B, 23C, and 23D showing various views of ice bucket and ice gate assembly according to the second exemplary embodiment of FIG. 13 consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rearward, upper, lower, upward, downward, and the like used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
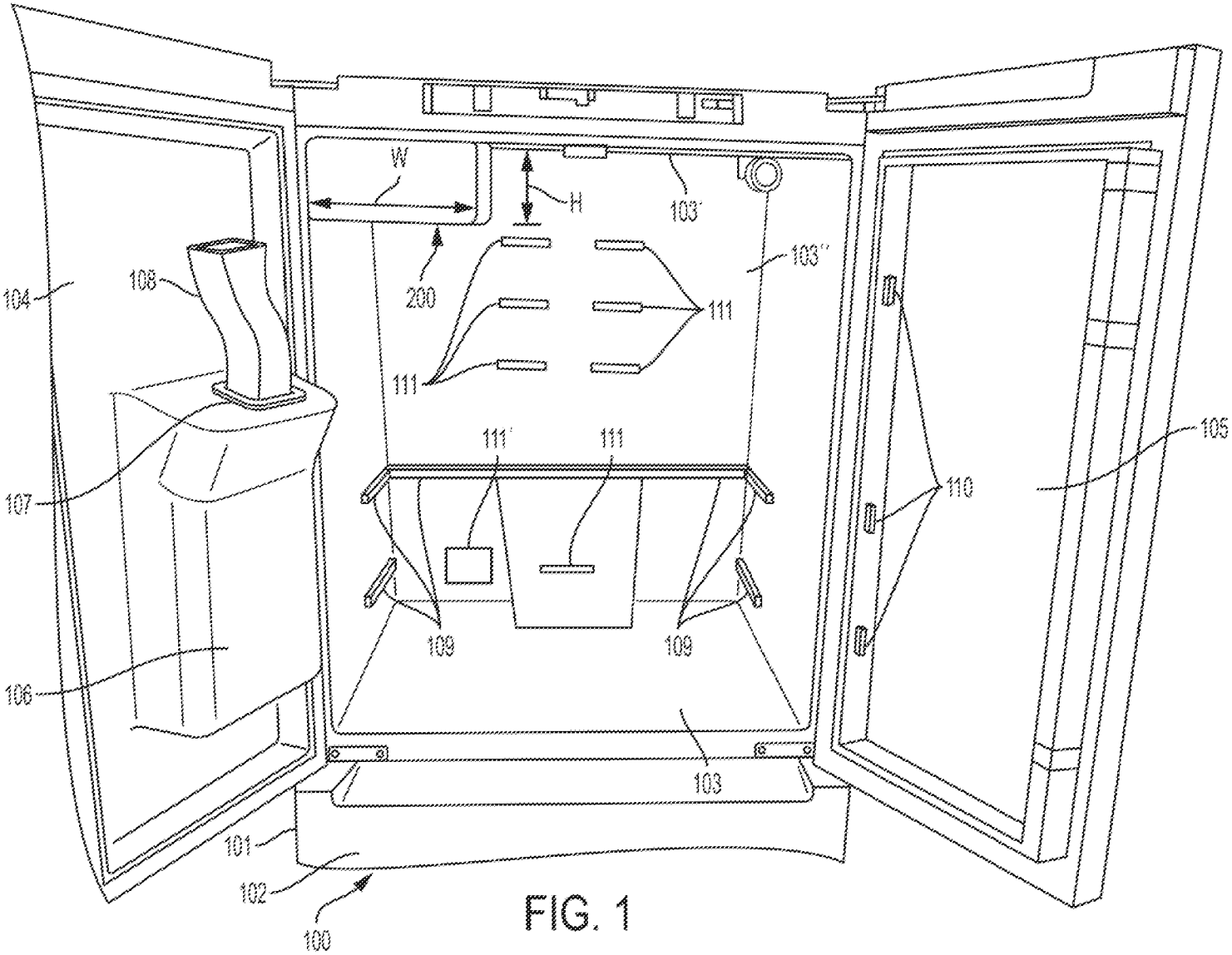
FIG. 1 illustrates a fragmentary front perspective view of a French door-bottom mount style refrigerator with the doors open to reveal the slimline ice compartment according to a first exemplary embodiment consistent with present disclosure.

FIG. 1 illustrates a front perspective view of a French door-bottom mount style refrigerator 100 with the doors open to reveal the slimline ice compartment 200 according to a first exemplary embodiment consistent with present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The left door 104 includes a projecting housing portion 106 on the inner liner and which accommodates a water and ice dispenser assembly (not visible) accessible by the user on the front side of the door 104. An opening 107 of a dispenser ice chute (not visible) for guiding ice to the dispenser is arranged at the top of the projecting housing portion 106. As will be described in more detail below, the dispenser ice chute communicates with an opening in a front cover of the ice bucket via an ice chute extension 108. The inner liner side walls of the fresh food compartment 103 include protrusions 109 for supporting shelving (not shown). The right door 105 includes projections 110 for supporting door racks (not shown). Also shown in FIG. 1 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

The slimline ice compartment 200 is disposed in an upper left hand corner of the fresh food compartment 103. The slimline ice compartment 200 can be located at other positions within the fresh food compartment 103, in one of the refrigerator doors 104, 105, or even in the freezer compartment 101 if desired, especially in a side-by-side freezer/refrigerator configuration. The slimline ice compartment 200 has a thin dimension in a vertical height direction H of approximately 5.6 inches±2.0 inches and has a horizontal width W of approximately 10.4 inches±2.0 inches.

Figure 2:
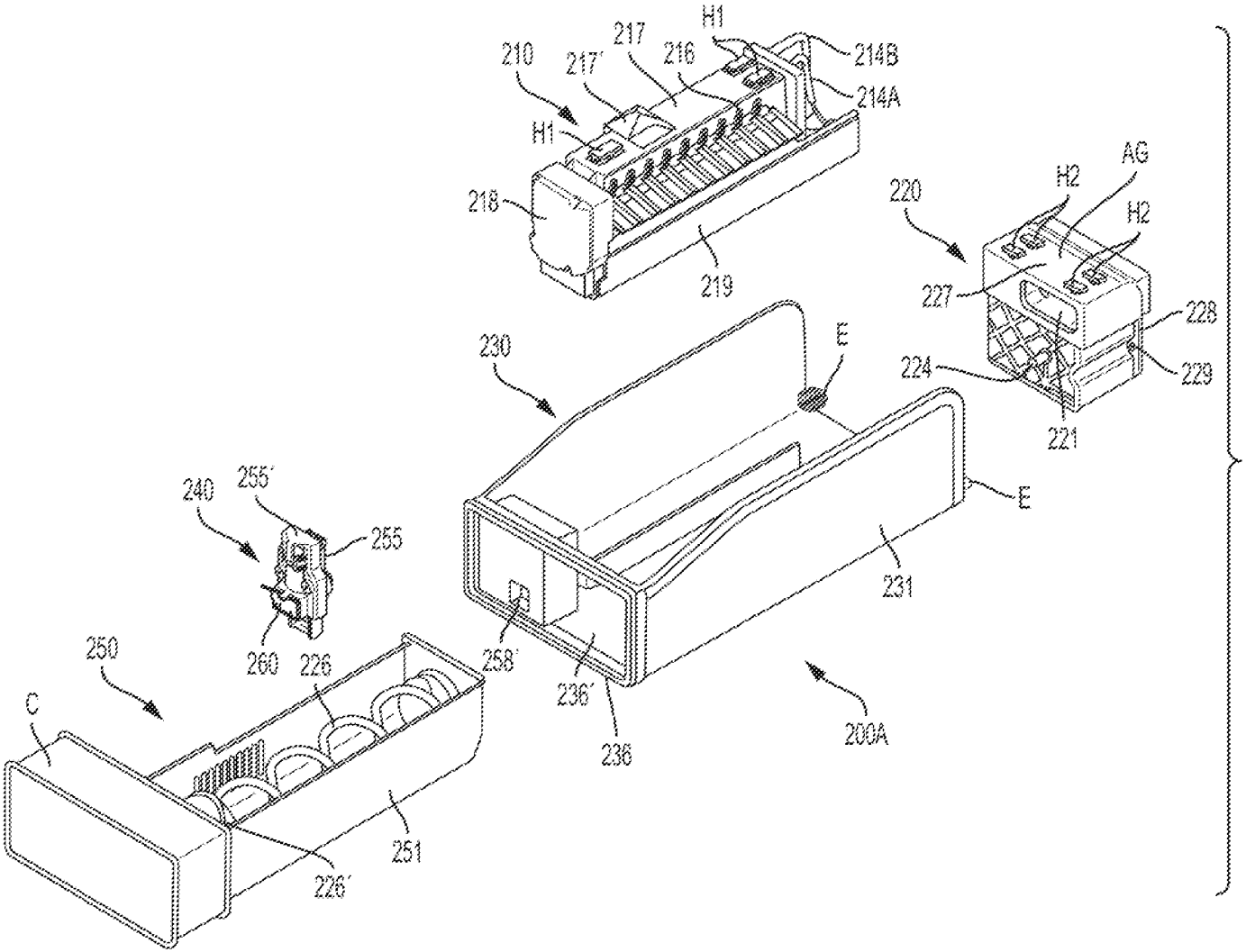
FIG. 2 is an exploded perspective view of the complete ice maker/ice bucket/ice compartment assembly according to the first exemplary embodiment consistent with present disclosure.
Figure 3A:
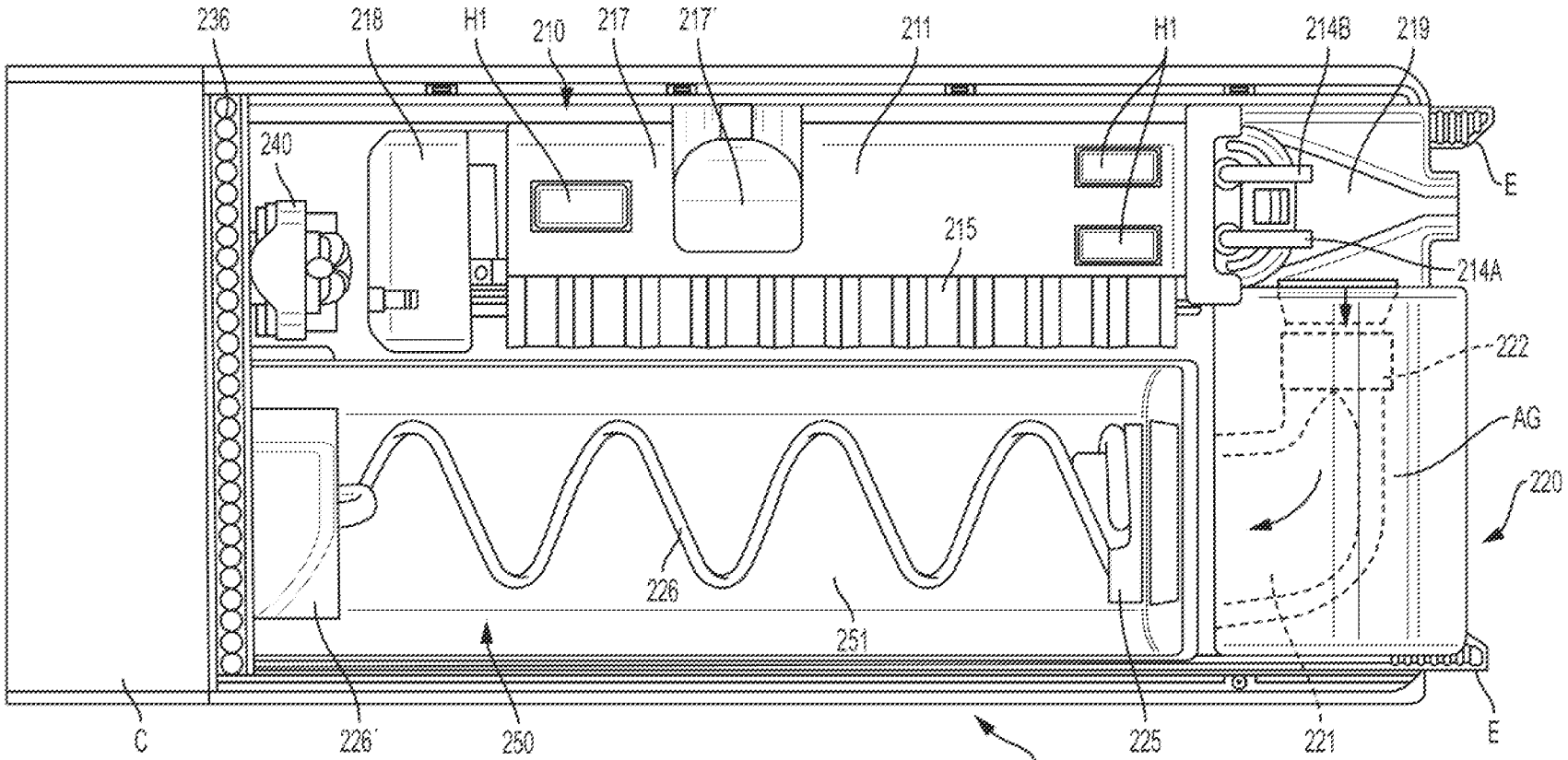
FIG. 3A is a top view of the complete ice maker/ice bucket/ice compartment assembly according to the first exemplary embodiment consistent with present disclosure.

FIG. 2 is an exploded perspective view of the complete ice maker/ice bucket/ice compartment assembly 200A (hereinafter referred to as "the complete ice maker compartment assembly 200A") according to an exemplary embodiment consistent with present disclosure. More specifically, the complete ice maker compartment assembly 200A includes an ice maker assembly 210, an air handler/auger motor assembly 220, an ice compartment housing assembly 230, a cube/crush DC motor and reed switch assembly 240, and the ice bucket assembly 250. FIG. 3A is a top view of the complete ice maker compartment assembly 200A according to an exemplary embodiment consistent with present disclosure. Aspects of each of the individual assemblies 210-250 will be discussed in more detail below in connection with the drawings.

Figure 3B:
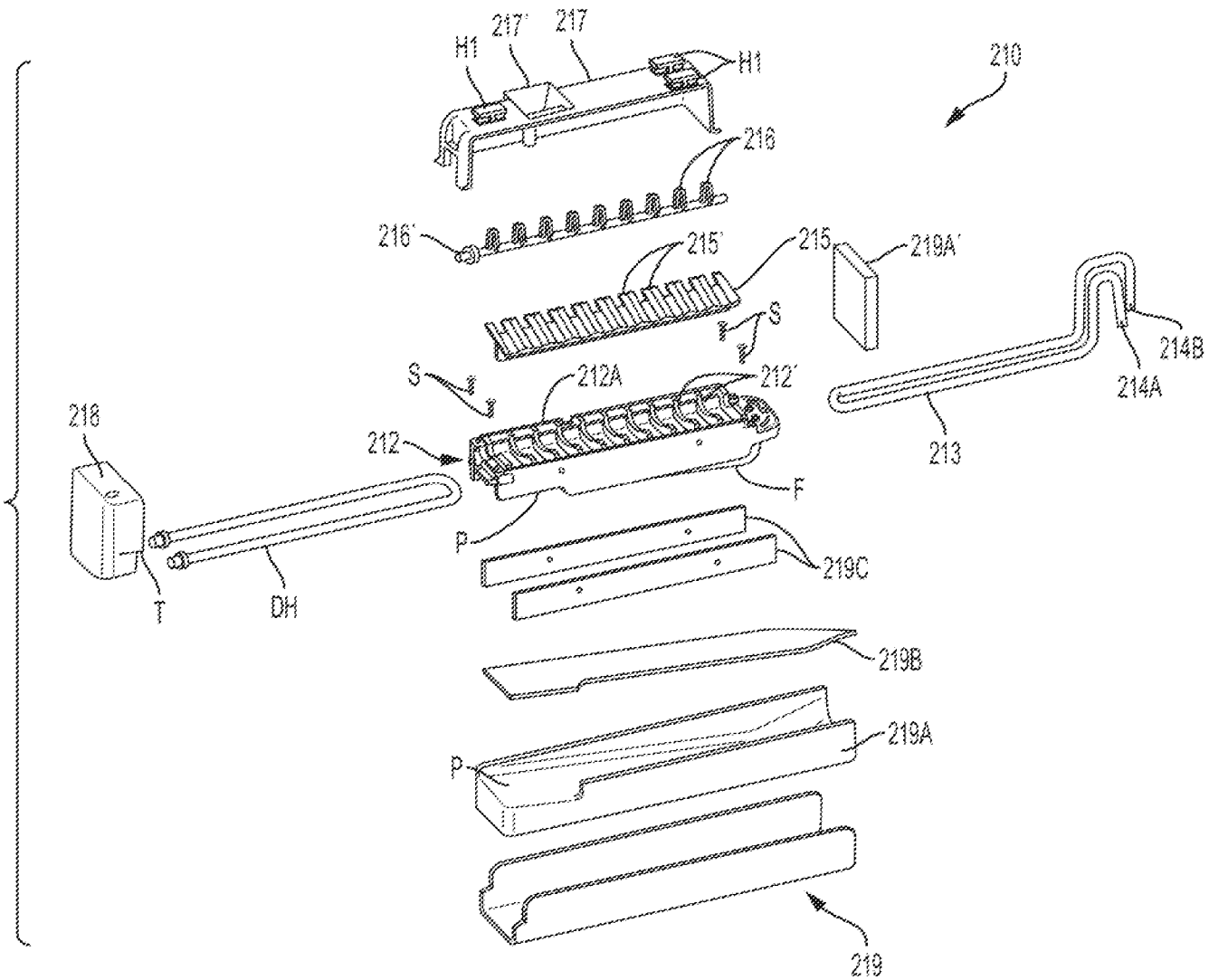
FIG. 3B is an exploded perspective view of the ice maker assembly according to the first exemplary embodiment consistent with present disclosure.

As shown in FIGS. 2, 3A, and 3B, the ice maker assembly 210 (which includes an ice maker 211) and the ice bucket assembly 250 (which includes an ice bucket 251) are arranged side-by-side or next to each other in a horizontal direction within the ice compartment housing assembly 230. In other words, no portion of the ice bucket 251 is located below the ice maker 211 when the ice maker 211 is projected downward in a vertical height direction.

With reference to the exploded view of FIG. 3B and FIGS. 9A-9C, the ice maker assembly 210 includes an ice maker tray/evaporator 212 having an evaporator cooling tube 213 (formed of at least one of copper or a copper alloy, for example) which is, for example, die cast over-molded inside an ice maker tray portion 212A (formed of at least one of aluminum, an aluminum alloy, or other die cast alloys, for example), such that the evaporator cooling tube 213 is embedded in and thus in direct contact with the ice maker tray portion 212A so as to form the ice maker tray/evaporator 212 as a one piece unit. FIGS. 9A-9C show the one piece, over-molded solution of the ice maker tray portion 212A, with FIG. 9C showing the cooling tube 213 inside the ice maker tray portion 212A using broken lines. Preferably, but not necessarily, the evaporator cooling tube 213 is formed of copper and the ice maker tray portion 212A is formed of aluminum. Alternatively, the ice maker tray/evaporator 212 is made in two halves. The evaporator cooling tube 213 has an evaporator tube inlet 214A with a capillary connection (i.e., the end is swaged and connected to a capillary tube), and an evaporator cooling tube outlet (suction tube) 214B.

As shown in FIG. 10, the evaporator cooling tube 213 (see FIG. 3B) is connected in a refrigerant circuit 500. The refrigerant circuit 500 includes the ice maker tray/evaporator 212 connected by the evaporator cooling tube outlet (suction tube) 214B in series with a freezer compartment evaporator 504 which is in turn connected to an accumulator 505, a compressor 506, a condenser 507, and a drier 508, and then connects to the evaporator tube inlet 214A having the capillary connection. The refrigerant circuit 500 also includes a bypass line 509 with capillary tube 510 and a refrigerant valve 511 which is located prior to the evaporator tube inlet 214A with the capillary connection in order to bypass the ice maker tray/evaporator 212 and communicate the refrigerant to the freezer compartment evaporator 504. The evaporator tube inlet 214A and the evaporator cooling tube outlet 214B are joined to the foamed-in refrigerator cabinet tubes (which are disposed in the insulated space at the rear of the refrigerator 100) by brazing or by a lock ring. The fresh food compartment 103 can use cold air selectively ducted by a damper 512 in a cold air supply 513 from the freezer compartment 101 and returned in a warm air return 514 (see FIG. 10), or can be part of a separate, independent refrigerant circuit having its own compressor, condenser, drier, capillary tube, and evaporator.

With reference to FIGS. 2, 3A, 3B, 6, 7C, and 9B, the ice maker tray portion 212A of the ice maker tray/evaporator 212 includes a mold with a plurality of cavities 212' for receiving water for making ice pieces (see FIGS. 3B and 9B). The ice maker tray/evaporator 212 includes molded evaporator fins F (see FIG. 7C) extending vertically downward from the bottom thereof and into an airflow passage P under the ice maker tray/evaporator 212. The evaporator fins F preferably extend down very close to the bottom surface of a form-fitted metal 219D which forms a defrost tray to avoid ice building up on the defrost tray at 219D (see FIG. 7C). Also, freezing the water in the plurality of cavities 212' from bottom to top is desirable as most of the salts dissolved as precipitates as the water temperature is brought down will be away from the ice tray surfaces thereby reducing accumulation (scale buildup) on the bottom of the ice tray, which in turn can cause problems of ejecting the ice pieces as the refrigerator appliance ages and/or if used in hard water regions.

As best shown in FIGS. 3A, 3B, 4A, 6, 7B, and 7C, an ice maker guard 215 is fastened to the side of the ice maker tray/evaporator 212 facing the ice bucket 251. The ice maker guard 215 includes a plurality of projections or fingers 215'. Ejector fingers 216 are arranged on a rotatable shaft 216' and are movable in spaces between the projections 215'. An ice maker bracket 217 is disposed above the mold with a plurality of cavities 212' and includes a water fill cup 217' for directing water into the cavities 212'. The ice maker bracket 217 is attached via fasteners (for example, four screws S) to the ice maker tray/evaporator 212. The ice maker bracket 217 also includes a plurality (for example three) of mounting hooks H1 on a top surface thereof for engaging corresponding mounting members M1 formed in a foamed-in bracket B which is part of the refrigerator structure (see FIGS. 8A, 8B, and 8C). The mounting hooks H1 allow the ice maker assembly 210 to be easily assembled to an inner top wall or liner 103' of the fresh food compartment 103 via the foamed-in bracket B as shown in FIGS. 8A-8C. FIG. 7B shows a wire harness WH for connecting the ice maker assembly 210 to the refrigerator 100. The wire harness WH may be connected to corresponding connectors (not shown) in, for example, the inner top wall 103' of the fresh food compartment 103 at a location within the ice compartment 200.

As shown in FIG. 3B, a defrost heater DH in the form of a loop is disposed under the ice maker tray/evaporator 212 and is operative to heat the ice maker tray/evaporator 212 during a harvest mode to release the pieces of ice for harvesting the pieces of ice and also serves to prevent any ice or frost buildup on the ice maker tray/evaporator 212 including underneath the same including on the evaporator fins F and on form-fitted metal 219D of the defrost tray (see FIG. 7C). The defrost heater DH can be easily replaced when service is required.

As best shown in FIGS. 2, 3A, 3B, 6, and 8A, a gear box 218 is positioned at a front end portion (facing the front of the refrigerator) of the ice maker tray/evaporator 212 and includes gears and a motor (not shown) for driving the rotatable shaft 216' and the bail arm or optical sensor system (not shown) that senses the amount of ice pieces in the ice bucket 251. A temperature or tray sensor such as a thermistor T is disposed on an outer portion of the gear box 218 facing the ice maker tray/evaporator 212 (see FIG. 3B). Alternatively, the thermistor T can be disposed directly on the ice maker tray/evaporator 212 (see FIG. 10). In this regard, there is no air temperature control inside the slimline ice compartment 200, rather the ice maker tray/evaporator 212 and an electric motor driven fan 222 (discussed in more detail below) within the ice compartment 200 are controlled using the thermistor T which directly monitors the ice/ice maker tray/evaporator 212 temperatures to cycle the motor driven fan 222 and bi-stable refrigerant valve 511 "ON" and "OFF" in order to keep the temperature inside the ice compartment 200 within established limits. Moreover, instead of just the one thermistor T, an additional temperature sensor (not shown) may be disposed inside the gear box 218 and sense the temperature of the plastic housing of the gear box 218. Still further, the additional temperature sensor (not shown) may be built into a body of the electric motor driven fan 222.

As best shown in FIGS. 2, 3B, 6, 7A-7C, and 8A, a drain assembly 219 having insulation 219A and 219A' (formed from, for example, expanded polypropylene (EPP)), a metal (for example, aluminum) drain plate 219B, and a collar 219C is positioned under and attached with the ice maker tray/evaporator 212. While the metal drain plate 219B is shown in FIG. 3B as a flat metal plate, it can also be form-fitted to the insulation 219A to form the defrost tray as shown at 219D in FIG. 7C. The drain assembly 219 is configured with an angle toward the rear so as to drain any water from a defrost mode of the ice maker assembly 210 away from a rear end portion (see FIGS. 6 and 7C) of the ice maker assembly 210 and communicates with tubing (not shown) which in turn communicates with an evaporation tray (not shown) in a machine room of the refrigerator 100. The drain assembly 219 also cooperates with the bottom of the ice maker tray/evaporator 212 to form the airflow passage P under the ice maker tray/evaporator 212 and through the evaporator fins F.

Figure 4B:
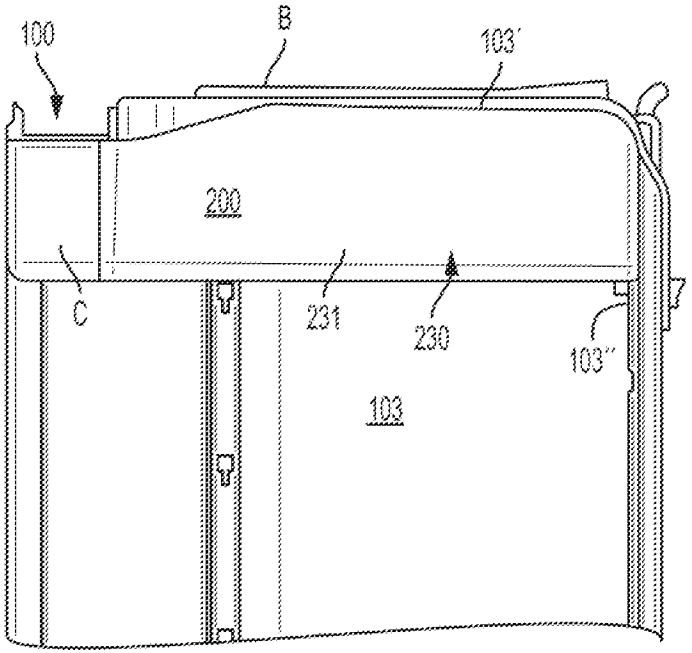
FIG. 4B is a fragmentary side elevational view showing the exterior of the ice compartment inside the refrigerator compartment according to the first exemplary embodiment consistent with present disclosure.
Figure 4A:
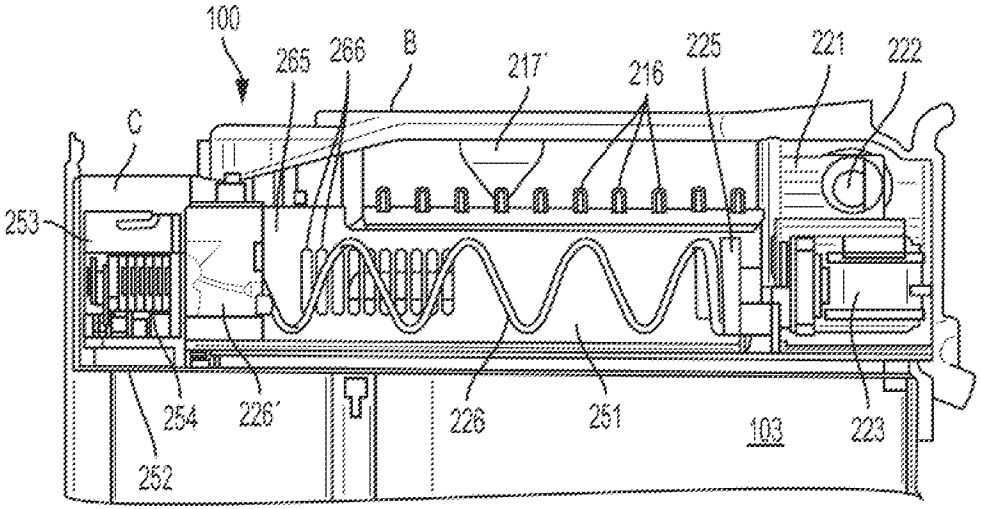
FIG. 4A is a fragmentary cutaway side elevational view showing the complete ice maker/ice bucket/ice compartment assembly according to the first exemplary embodiment consistent with present disclosure.

With reference to FIGS. 2, 3A, and 4A, the air handler/auger motor assembly 220 is disposed at the rear portion of the slimline ice compartment 200. The air handler/auger motor assembly 220 includes an air guide AG with an air duct or passage 221 having the electric motor driven fan 222 disposed therein. Although the electric motor driven fan 222 is shown with a vertical orientation, the electric motor driven fan 222 can also be oriented horizontally in a vertical portion of the air duct 221. The air duct 221 is located at an upper portion of the air handler/auger motor assembly 220. The air duct 221 communicates with a rear end portion P2 (see FIGS. 6 and 7B) of the airflow passage P under the ice maker tray/evaporator 212. An inlet of the electric motor driven fan 222 communicates with the airflow passage P under the ice maker tray/evaporator 212 and through the evaporator fins F such that the electric motor driven fan 222 creates a suction and draws cool air from the ice maker tray/evaporator 212 and discharges the cool air through the air duct 221 and either over or around the ice bucket 251 to prevent the ice pieces from melting. The cool or cold air that circulates inside the ice compartment 200 is only required to keep the ice compartment 200 cold enough to prevent ice stored in the ice bucket 251 from melting which is normally below −3° C. and preferably, but not necessarily, around −5° C. The air duct 221 makes a substantially 90 degree turn and widens prior to emptying into the ice bucket 251. An auger motor 223 is located at a lower portion of the air handler/auger motor assembly 220. The auger motor 223 includes a motor shaft 224 that is connected via a coupler 225 to an auger member 226 such as a coiled auger wire or tube or the like. The other end of the auger member 226 is connected to an auger drum 226' which guides the ice pieces to the crushing blades and the opening in the front cover which are discussed later.

The air handler/auger motor assembly 220 includes a plurality (for example four) of mounting hooks H2 on the top surface 227 (see FIG. 2) for engaging corresponding mounting members M2 (shown schematically in FIGS. 8A and 8B) formed in the foamed-in bracket B which is part of the refrigerator structure for mounting the air handler/auger motor assembly 220 to the fresh food compartment 103. The air handler/auger motor assembly 220 may also include one or more vertical mounting plates 228 with fastener holes 229 (see FIG. 2) for further mounting the air handler/auger motor assembly 220 to an inner back wall or liner 103" of the fresh food compartment 103 via fasteners such as screws (not shown).

Figure 5:
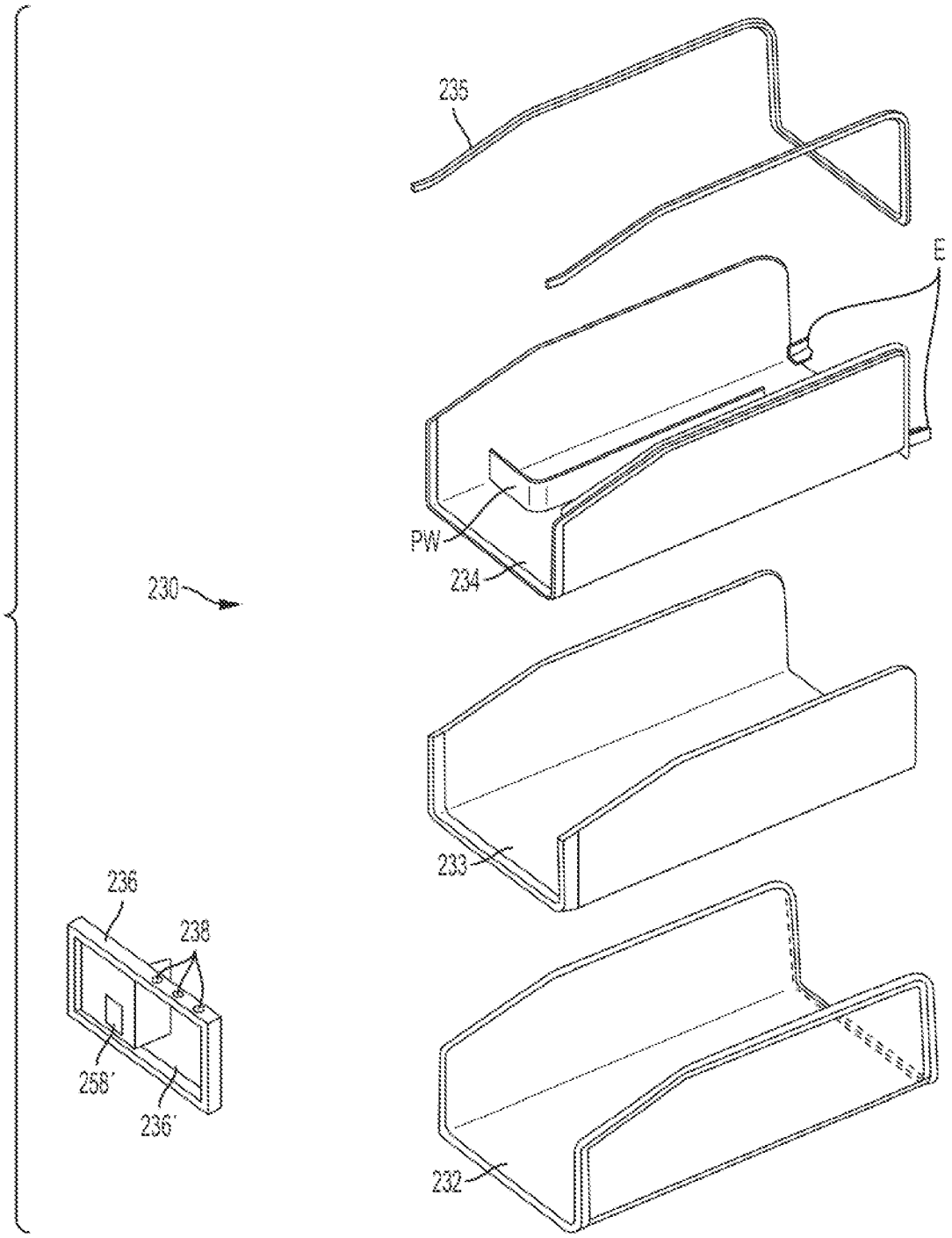
FIG. 5 is an exploded perspective view of a U-shaped ice compartment assembly according to an exemplary embodiment consistent with present disclosure.
Figure 6:
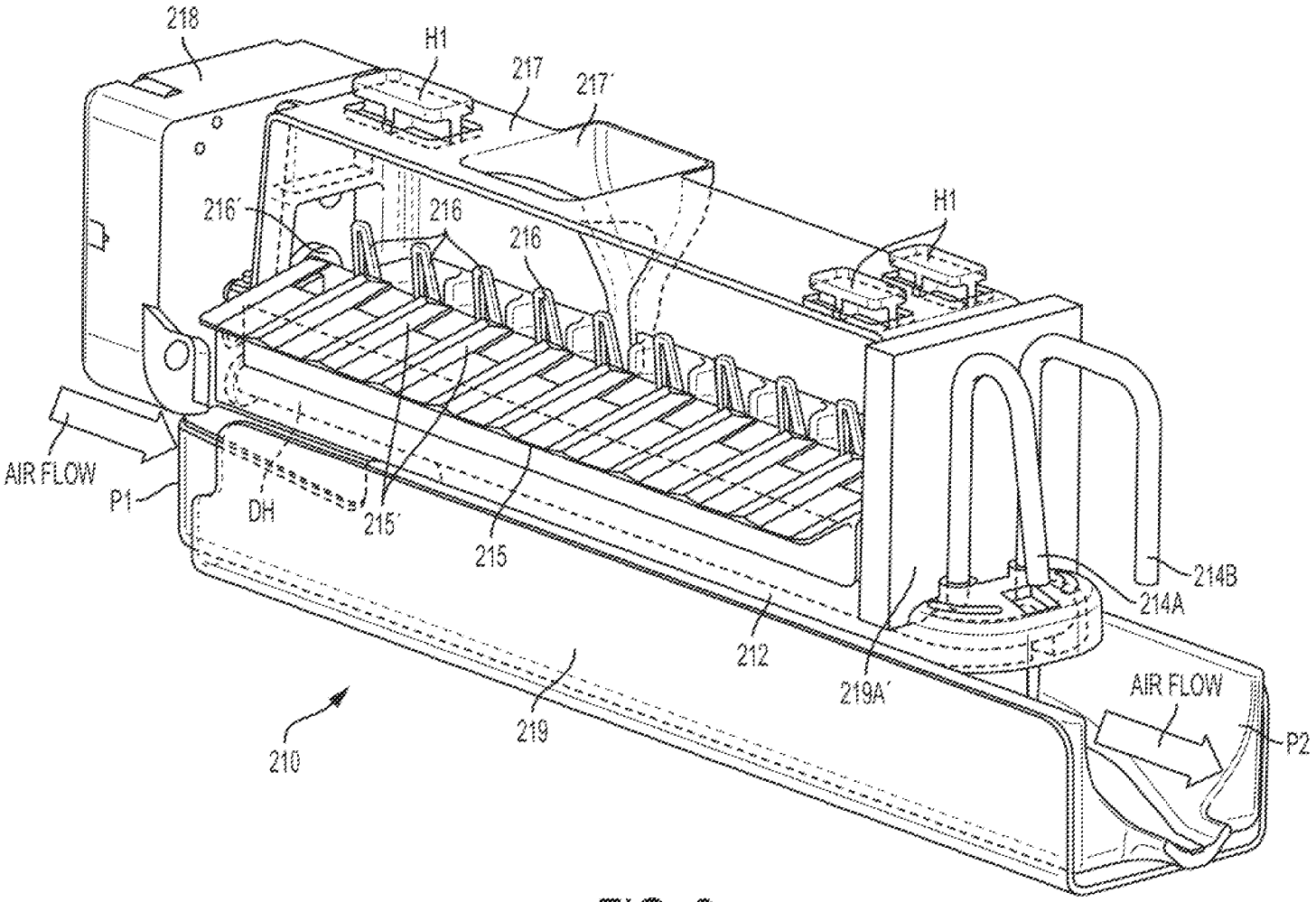
FIG. 6 is a perspective view of the ice maker assembly according to the first exemplary embodiment consistent with present disclosure.

As best shown in FIGS. 2, 4B, and 5, one embodiment of the ice compartment housing assembly 230 is formed by a U-shaped, insulated housing 231 that cooperates with the inner top wall 103' and the inner back wall 103" of the fresh food compartment 103. As best shown in FIG. 4B, the U-shaped, insulated housing 231 is contoured to fit the shape of the inner top wall 103' and an inner back wall 103" of the fresh food compartment 103. The U-shaped, insulated housing 231 includes a U-shaped outer wall 232, a U-shaped insulation 233 (formed of, for example, expanded polypropylene (EPP), expanded polystyrene (EPS), vacuum insolated panel (VIP)), a U-shaped inner wall 234, a gasket 235 that is disposed between an edge of the U-shaped, insulated housing 231 and the inner top wall 103' and the inner back wall 103" of the fresh food compartment 103, and a housing collar 236 that is disposed on an open front portion of the U-shaped, insulated housing 231, the housing collar 236 having an opening 236' therein for receiving the ice bucket 251. The gasket 235 may be an extruded gasket formed from, for example, polyvinyl chloride (PVC) that is rubberized, and that is inserted into a groove that is formed along the edge of the U-shaped, insulated housing 231. The U-shaped, insulated housing 231 includes an inner L-shaped positioning wall PW (see FIG. 5) for positioning the U-shaped, insulated housing into position over the ice maker assembly 210. The U-shaped, insulated housing 231 also includes locating extensions E (for example, two extensions E) extending from a lower rear portion of the edge, the locating extensions E being configured to fit into a bracket (not shown) positioned in the inner back wall 103" of the fresh food compartment 103. Moreover, the housing collar 236 having the opening 236' therein for receiving the ice bucket 251 further includes a plurality of fastener holes 238 configured to receive fasteners (for example, three screws, not shown) for fastening the U-shaped, insulated housing 231 to the inner top wall 103' of the fresh food compartment 103. With such a construction, the U-shaped, insulated housing 231 is slid into position in the upper left hand corner of the fresh food compartment 103 and over the ice maker assembly 210 and then held in place by the locating extensions E at the lower rear portion and the fasteners in the holes. The insulated housing 231 is not limited to a U-shape and can also be other shapes such as, for example, L-shaped.

Figure 12C:
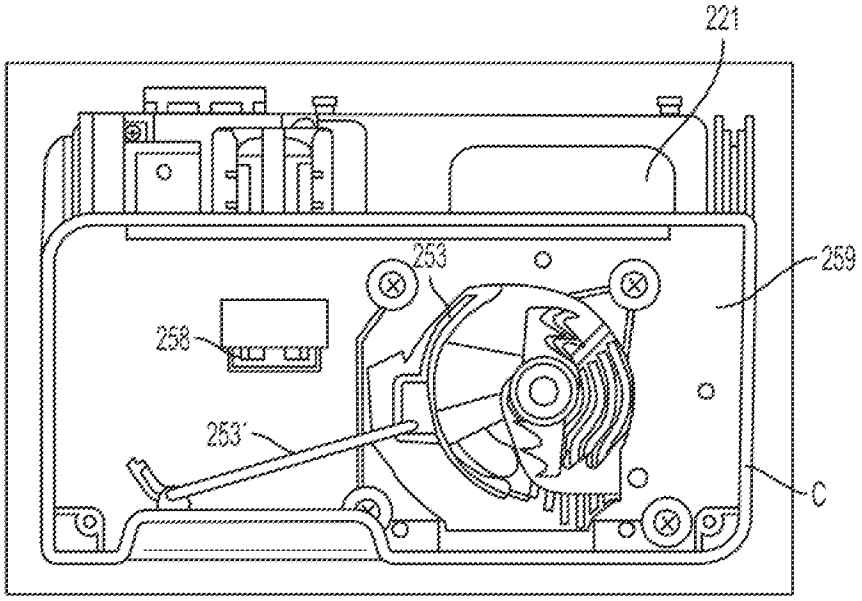
Figure 12D:
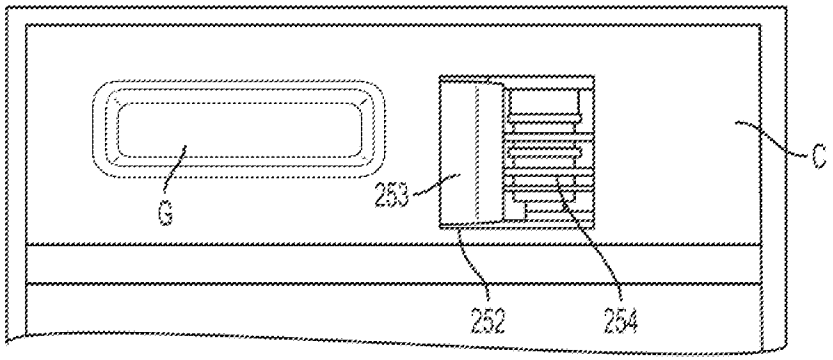
Figure 12A:
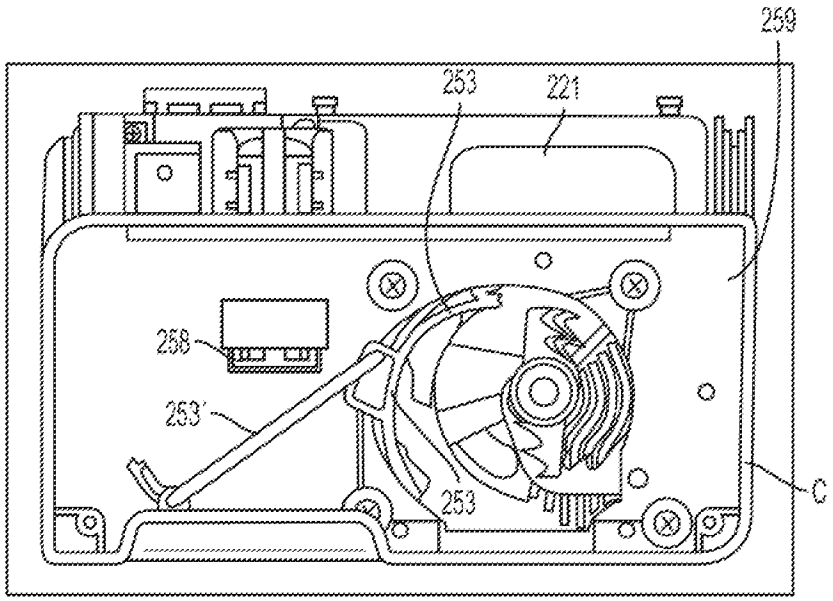

With reference to FIGS. 2, 3A, 4A, 11, and 12A-12C, the cube/crush DC motor and reed switch assembly 240 is disposed within the ice compartment housing assembly 230 at a location in front of the ice maker assembly 210 and is mounted, for example, to a back wall of the housing collar 236 or similar. The cube/crush DC motor and reed switch assembly 240 is used to control whether cubed or crushed ice is delivered to the user. More specifically, the ice bucket assembly 250 has an ice bucket outlet opening 252 (seen from bottom in FIGS. 12B and 12D) in a front cover C through which ice pieces are delivered, as will be described in more detail below. As shown in FIGS. 12A and 12C, the ice bucket outlet opening 252 has an ice gate 253 that pivots, such that the ice gate 253 opens or closes. When the ice gate 253 is closed (see FIGS. 12C and 12D), it forces the ice pieces, such as in the shape of cubes, towards a plurality of crushing blades 254 (for example, when "crushed" ice is selected by the user). On the other hand, when "cubed" ice is selected by the user, the ice gate 253 opens (see FIGS. 12A and 12B) thus allowing the ice cubes to come out through the ice bucket outlet opening 252 missing the crushing blades. The default position for the ice gate 253 is closed, and this minimizes any ice cubes from falling out through the ice bucket opening 252 when the user pulls out the ice bucket assembly 250. This also prevents the user from touching the blades while pulling out the ice bucket assembly 250. The pivoting of the ice gate 253 is carried out by a rod 253' (see FIGS. 12A and 12C) that engages into an actuator head that is controlled by a cube/crush DC reversible motor 255 (for example, a 12 volt DC reversible electric motor as shown in FIG. 11) that moves up (opening the ice gate 253) and down (closing the ice gate 253). The rod 253' passes through an opening 258' in the housing collar 236 (see FIG. 2). The ice bucket assembly 250 has a magnet 258 disposed on a gate cover 259 of the front cover C of the ice bucket assembly 250 and that interfaces with a reed switch 260 that is assembled on a motor bracket 255' of the cube/crush DC reversible motor 255 (see FIGS. 2 and 11). Accordingly, when the ice bucket 251 with front cover C is removed from the opening 236' in the housing collar 236 of the ice compartment 200, the reed switch 260 opens the circuit thereby disabling: any ice dispensing, the ice maker 211, and the electric motor driven fan 222. This in turn prevents any ice harvesting while the ice bucket assembly 250 is not present, and also minimizes moisture ingress inside the ice compartment 200. Once the ice bucket assembly 250 is placed back into the ice compartment housing assembly 230, the normal operation is resumed.

With reference to FIGS. 2, 3, 4A, 12B, and 12D, the ice bucket assembly 250 includes the ice bucket or bin 251 for storing ice pieces and in which the auger member 226 is disposed, and the front cover C. As noted above, the ice bucket 251 is removably mounted in the slimline ice compartment 200. As shown in FIG. 4A, in one embodiment, an inner side wall 265 of the ice bucket 251 is formed with a plurality of through-holes or slots 266 which allow the air that has cooled the ice to exit the ice bucket 251 and enter at a front end portion P1 of the airflow passage P under the ice maker tray/evaporator 212 to be cooled again (see FIGS. 7A and 7B). As noted above, the front cover C has the ice bucket outlet opening 252 on the bottom through which ice pieces are delivered when a user dispenses ice pieces. The ice bucket outlet opening 252 cooperates with the ice chute extension 108 to deliver ice pieces to the dispenser when the door 104 is in a closed position. The interface between the ice bucket outlet opening 252 and the top of the ice chute extension 108 can be sealed with a gasket, have a partial or open gasket, or have no gasket at all. In the latter two cases, some air is permitted to move between the fresh food compartment 103 and the ice compartment 200 by moving into the region inside the ice chute extension 108 and through the ice bucket outlet opening 252 and into the ice compartment 200 and vice versa.

Figure 12B:
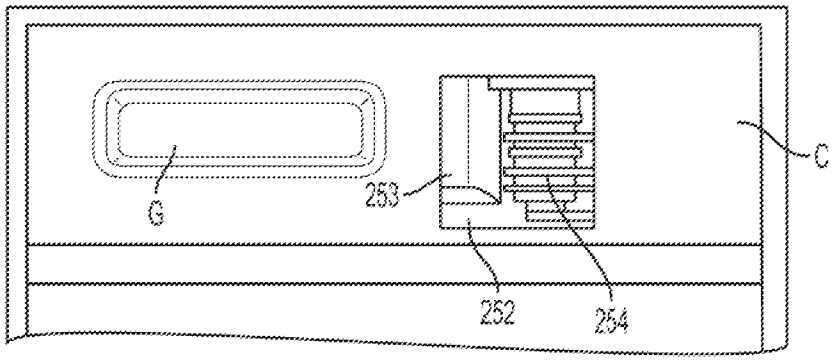

FIGS. 12B and 12D show that the bottom of the front cover C also includes a gripper recess G for the user to insert their fingers to pull and remove the ice bucket 251 or return the same into position. The hollow inside of the front cover C includes insulation, and the insulation may entirely fill the inside of the front cover C. Alternatively, the lower region around the ice bucket outlet opening 252 may be free of any insulation.

In operation and during the ice making mode, the refrigerant valve 511 (see FIG. 10) directs the refrigerant gas through the evaporator tube 213 which directly contacts the ice tray by virtue of being die cast over-molded inside the ice maker tray/evaporator 212. A water fill valve (not shown) that is located in the water fill tube that connects to the connection WF (see FIG. 8B) is opened in order to fill the cavities 212' with water and then is closed after a predetermined period of time (e.g., 5 seconds) has elapsed. Once the water in the individual cavities 212' is frozen, which is determined by the thermistor T that continuously senses the ice maker tray/evaporator 212 up to a predefined temperature, the refrigerant valve 511 bypasses or diverts the refrigerant gas to, for example, the freezer evaporator 504 and then the defrost heater DH is turned "ON". Once a predetermined temperature is reached, the defrost heater DH is turned "OFF" and the ejector fingers 216 are rotated by the shaft 216' to scoop out the ice pieces (for example, ice cubes) from the tray cavities 212'. After a complete turn of 360 degrees of the ejector fingers, the cycle is restarted with water by the water fill valve (see connection WF for a water fill tube in FIG. 8B) filling the cavities 212' and the refrigerant valve 511 redirecting the refrigerant to the ice maker tray/evaporator 212.

FIG. 13 illustrates a front view of a French door-bottom mount style refrigerator 600 with the doors open to reveal the slimline ice compartment 700 according to a second exemplary embodiment consistent with present disclosure. More specifically, the refrigerator 600 includes an insulated body having a freezer compartment 601 (bottom mount style) covered by a freezer door 602, and a fresh food or refrigerator compartment 603 located above the freezer compartment 601 and having two refrigerator doors 604 and 605 (French door style) which are shown in the open position. While two refrigerator doors are shown, clearly a single refrigerator door could be used, or more than two doors such as with door-in-door configurations. The shelves and food racks have been removed from inside the fresh food compartment 603 and from the inside of the refrigerator doors 604 and 605 for ease of understanding. The left door 604 includes projections 610 for supporting door racks (not shown). The left door 604 also includes a projecting housing portion 606 on the inner liner and which accommodates a water and ice dispenser assembly (not visible) accessible by the user on the front side of the door 604. An opening 607 of a dispenser ice chute (not visible) for guiding ice to the dispenser is arranged at the top of the projecting housing portion 606. The inner liner side walls of the fresh food compartment 603 include tracks 609 for supporting shelving (not shown). The right door 605 also includes projections 610 for supporting door racks (not shown). Also shown in FIG. 13 are air openings 611 for cold air to enter into the fresh food compartment 603 and openings 611' for return air to exit the fresh food compartment 603 (see the larger square on the bottom left). The freezer compartment is typically set at −18° C. or colder, and the fresh food compartment is typically set in a range of 1° C. to 4° C.

The slimline ice compartment 700 is disposed in an upper left hand corner of the fresh food compartment 603. The slimline ice compartment 700 can be located at other positions within the fresh food compartment 603, in one of the refrigerator doors 604, 605, or even in the freezer compartment 601 if desired, especially in a side-by-side freezer/refrigerator configuration. The slimline ice compartment 600 has a thin dimension in a vertical height direction H of approximately 5.6 inches±2.0 inches and has a horizontal width W of approximately 10.4 inches±2.0 inches.

FIG. 14 is an exploded perspective view of the complete ice maker/ice bucket/ice compartment assembly 700A (hereinafter referred to as "the complete ice maker compartment assembly 700A") according to the second exemplary embodiment of FIG. 13 consistent with present disclosure. More specifically, the complete ice maker compartment assembly 700A includes an ice maker assembly 710, an air handler/auger motor assembly 720, an ice compartment housing assembly 730, a cube/crush motor assembly 740, and the ice bucket assembly 750. FIG. 15A is a top view of the complete ice maker compartment assembly 700A according to the second exemplary embodiment of FIG. 13 consistent with present disclosure. Aspects of each of the individual assemblies 710-750 will be discussed in more detail below in connection with the remaining drawings.

As shown in FIGS. 14, 15A, and 15B, the ice maker assembly 710 (which includes an ice maker 711) and the ice bucket assembly 750 (which includes an ice bucket 751) are arranged side-by-side or next to each other in a horizontal direction within the ice compartment housing assembly 730. In other words, no portion of the ice bucket 751 is located below the ice maker 711 when the ice maker 711 is projected downward in a vertical height direction. Note that as defined herein, an optical sensor OSE (emitter) and an optical sensor OSR (receiver) (described later) are not part of the ice maker 711 per se, especially to the extent that they extend out over the top of the ice bucket 751. Both optical sensors may be supplied as part of the ice maker assembly 710 as a single component, the emitter OSE is assembled into an ice maker bracket/frame 717 and wired into a gear box 718 (see FIG. 15B), while the receiver OSR is assembled inside the gear box 718, with the lenses sticking out. Another way in which to describe the slimline feature is that the ice bucket 751 is arranged side-by-side with the ice maker 711 and a drain assembly 719 (described later) in a horizontal direction within the slimline ice compartment 700, such that a bottom portion 751BP of the ice bucket 751 is located at substantially the same level as a bottom portion 719BP of the drain assembly 719 in a vertical height direction (see FIG. 16C).

With reference to the exploded view of FIG. 15B and FIGS. 21A-21C, the ice maker assembly 710 comprises an integral ice maker assembly unit 712 having an ice maker tray or ice maker tray portion 712A, a fin evaporator or fin evaporator portion 712B, and a cooling tube 713 (formed of at least one of copper or a copper alloy, for example). The ice maker tray portion 712A is formed of at least one of aluminum, an aluminum alloy, or other die cast alloys, for example. The cooling tube 713 is assembled between the ice maker tray 712A and the fin evaporator 712B and thus is in direct contact with the ice maker tray 712A and the fin evaporator 712B, so as to form the integral ice maker assembly unit 712. FIGS. 21A, 21B, and 21C are various views showing the ice maker tray 712A, fin evaporator 712B, and cooling tube 713 assembly according to the second exemplary embodiment of FIG. 13 consistent with present disclosure. Preferably, but not necessarily, the cooling tube 713 is formed of copper and the ice maker tray portion 712A is formed of aluminum. The ice maker tray 712A and the fin evaporator 712B are made in two separate and distinct pieces that are assembled together using, for example, an ice maker tray clip 712A' and another screw (not shown). The cooling tube 713 has a cooling tube inlet 714A with a capillary connection (i.e., the end is swaged and connected to a capillary tube), and a cooling tube outlet (suction tube) 714B. Ice maker insulation 711A is disposed at the rear end portion of the ice maker 711.

The integral ice maker assembly unit 712 is connected to the refrigerant circuit 500 in the same manner as the ice maker tray/evaporator 212 as shown in FIG. 10 and described above, so that a discussion will be dispensed with for the sake of brevity.

With reference to FIGS. 14, 15A, 15B, 18, 19C, and 21B, the ice maker tray portion 712A of the integral ice maker assembly unit 712 includes a mold with a plurality of cavities 712' for receiving water for making ice pieces (see FIGS. 15B and 21C). The fin evaporator 712B includes a plurality of molded evaporator fins FF (see FIGS. 15B, 19C, and 21A) extending vertically downward from the bottom thereof and into an airflow passage PP under the integral ice maker assembly unit 712. The evaporator fins FF preferably extend down very close to the bottom surface of a defrost tray (described below) to avoid ice building up on the defrost tray. Also, freezing the water in the plurality of cavities 712' from bottom to top is desirable as most of the salts dissolved as precipitates as the water temperature is brought down will be away from the ice tray surfaces thereby reducing accumulation (scale buildup) on the bottom of the ice tray, which in turn can cause problems of ejecting the ice pieces as the refrigerator appliance ages and/or if used in hard water regions.

As best shown in FIGS. 15B, 18, and 19A, an ice maker guard 715 is fastened to the side of the integral ice maker assembly unit 712 facing the ice bucket 751. The ice maker guard 715 includes a plurality of projections or fingers 715'. Ejector fingers or plates 716 are arranged on a rotatable shaft 716' and are movable in spaces between the projections 715'. The rotatable shaft 716' is supported in an ejector finger bearing 716". The ice maker bracket 717 is disposed above the mold with a plurality of cavities 712' and includes a water fill cup 717' for directing water into the cavities 712'. The ice maker bracket 717 is attached via fasteners (for example, screws) to the integral ice maker assembly unit 712. The ice maker bracket 717 also includes a plurality (for example three) of mounting hooks HH1 on a top surface thereof for engaging corresponding mounting members MM1 assembled directly into an inner top wall 603' which is part of the refrigerator structure (see FIGS. 20A and 20B). The mounting hooks HH1 allow the ice maker assembly 710 to be easily assembled to the inner top wall 603' of the liner of the fresh food compartment 603 as shown in FIGS. 20A and 20B. As in the first embodiment, a harness connector of the wire harness (not shown) may be connected to a corresponding connector (not shown) in, for example, the inner top wall 603' of the fresh food compartment 603 at a location within the ice compartment 700. FIGS. 20A and 20B also show recessed light emitting diode (LED) refrigerator compartment lighting RL.

As shown in FIG. 15B, a defrost heater DDH in the form of a loop is disposed between the ice maker tray portion 712A and the fin evaporator 712B and is operative to heat the ice maker tray portion 712A during a harvest mode to release the pieces of ice for harvesting the pieces of ice and also serves to prevent any ice or frost buildup on the integral ice maker assembly unit 712 including underneath the same including on the evaporator fins FF and on the defrost tray (see also FIG. 19C).

As best shown in FIGS. 14, 15A, 15B, 18, and 20B, the gear box 718 is positioned at a front end portion (facing the front of the refrigerator) of the integral ice maker assembly unit 712 and includes gears and a motor (not shown) for driving the rotatable shaft 716' and the bail arm or optical sensor system that senses the amount of ice pieces in the ice bucket 751. In the second embodiment, an optical sensor system, comprising the optical sensor OSE (emitter) that is disposed on the ice maker bracket 717 and the optical sensor OSR (receiver) that is disposed on the gear box 718, is provided for sensing the amount of ice pieces in the ice bucket 751. The receiver OSR is built into the gear box 718, while the emitter OSE has its own housing that is latched on the right rear end of the ice maker bracket 717 (see FIGS. 14, 15A, 15B, 18, and 19C). A temperature or tray sensor such as a thermistor TT is disposed on an outer portion of the gear box 718 facing the integral ice maker assembly unit 712 (see FIG. 15B). Alternatively, like the thermistor T (see the tray sensor T in FIG. 10), the thermistor TT can also be disposed directly on the integral ice maker assembly unit 712. In this regard, there is no air temperature control inside the slimline ice compartment 700, rather the integral ice maker assembly unit 712 and an electric motor driven fan 722 (discussed in more detail below) within the ice compartment 700 are controlled using the thermistor TT which directly monitors the ice/integral ice maker assembly unit 712 temperatures to cycle the motor driven fan 722 and bi-stable refrigerant valve 511 "ON" and "OFF" in order to keep the temperature inside the ice compartment 700 within established limits. Moreover, instead of just the one thermistor TT, an additional temperature sensor (not shown) may be disposed inside the gear box 718 and sense the temperature of the plastic housing of the gear box 718. Still further, the additional temperature sensor (not shown) may be built into a body of the electric motor driven fan 722.

As best shown in FIGS. 14, 15B, 18, 19A-19C, and 20A, the drain assembly 719, including a drain housing 719A, drain insulation 719B (formed from, for example, expanded polypropylene (EPP)), and a metal (for example, aluminum) drain plate 719C, is positioned under and attached with the integral ice maker assembly unit 712. While the metal drain plate 719C is shown in FIG. 15B as a substantially flat metal plate, it can also be form-fitted to the drain insulation 719B to form the defrost tray. The drain assembly 719 is configured with an angle toward the rear so as to drain any water from a defrost mode of the ice maker assembly 710 away from a rear end portion (see FIGS. 18 and 19B) of the ice maker assembly 710 and communicates with tubing (not shown) which in turn communicates with an evaporation tray (not shown) in a machine room of the refrigerator 600. The drain assembly 719 also cooperates with the bottom of the integral ice maker assembly unit 712 to form the airflow passage PP under the integral ice maker assembly unit 712 and through the evaporator fins FF. A heater plate HP (formed of, for example, aluminum) and an extender housing EH (a plastic injected part) are attached at the rear end of the drain assembly 719 (see FIGS. 15B and 19C). The aluminum heater plate HP and molded plastic extender housing EH transfer the heat from the defrost heater DDH (by conduction/contact) into the drain hole. This prevents any defrost water from freezing/icing up the drain opening, which would cause blocking/clogging of the drain tube.

With reference to FIGS. 14, 15A, and 16A, the air handler/auger motor assembly 720 is disposed at the rear portion of the slimline ice compartment 700. The air handler/auger motor assembly 720 includes an air guide AAG with an air duct or passage 721 having the electric motor driven fan 722 disposed therein. Although the electric motor driven fan 722 is shown with a vertical orientation, the electric motor driven fan 722 can also be oriented horizontally in a vertical portion of the air duct 721. The air duct 721 is located at an upper portion of the air handler/auger motor assembly 720. The air duct 721 communicates with a rear end portion PP2 (see FIG. 18) of the airflow passage PP (see FIG. 15B) under the integral ice maker assembly unit 712. An inlet of the electric motor driven fan 722 communicates with the airflow passage PP under the integral ice maker assembly unit 712 and through the evaporator fins FF such that the electric motor driven fan 722 creates a suction and draws cool air from the integral ice maker assembly unit 712 and discharges the cool air through the air duct 721 and either over or around the ice bucket 751 to prevent the ice pieces from melting. In this regard, an ice compartment air duct member 721A that communicates with the outlet of air duct 721 can be used to direct and distribute the cool air over the ice pieces in the ice bucket 751. As shown in FIG. 15A, the top of the ice compartment air duct member 721A includes a sliding member 721B and a latching member 721C for attaching the ice compartment air duct member 721A to the inner top wall 603' of the refrigerator compartment 603 (see FIG. 16B). The cool or cold air that circulates inside the ice compartment 700 is only required to keep the ice compartment 700 cold enough to prevent ice stored in the ice bucket 751 from melting which is normally below −3° C. and preferably, but not necessarily, around −5° C. The air duct 721 makes a substantially 90 degree turn and widens prior to emptying into the ice bucket 751. An auger motor 723 is located at a lower portion of the air handler/auger motor assembly 720. The auger motor 723 (see FIG. 16A) includes a motor shaft 724 (see FIG. 14) that is connected via a coupler 725 to an auger member 726 such as a coiled auger wire or tube or the like. The other end of the auger member 726 is connected to an auger drum 726' which guides the ice pieces to the crushing blades and the opening in the front cover which are discussed later.

The air handler/auger motor assembly 720 includes a plurality (for example two) of mounting hooks HH2 on the top surface 727 (see FIG. 14) for engaging corresponding mounting members MM2 (shown schematically in FIGS. 20A and 20B) mounted on the inner top wall 603' of the liner (see FIG. 16B) and the foamed-in refrigerator structure for mounting the air handler/auger motor assembly 720 to the fresh food compartment 603. The air handler/auger motor assembly 720 may also include other mounting members (not shown) for further mounting the air handler/auger motor assembly 720 to an inner back wall or liner 603" of the fresh food compartment 603 via fasteners such as screws (not shown).

As best shown in FIGS. 14, 16A, 16B, 16C, and 17, the ice compartment housing assembly 730 is formed by a L-shaped, insulated housing 731 that cooperates with the inner top wall 603', the inner back wall 603", and the inner side wall 603'" (see FIGS. 20A and 20B) of the fresh food compartment 603. As best shown in FIG. 16B, the L-shaped, insulated housing 731 is contoured to fit the shape of the inner top wall 603' and the inner back wall 603" of the fresh food compartment 603. The L-shaped, insulated housing 731 includes an L-shaped outer wall 732, an L-shaped insulation 733 (formed of, for example, expanded polyurethane (PU), expanded polypropylene (EPP), expanded polystyrene (EPS), vacuum insolated panel (VIP)), an L-shaped inner wall 734, a gasket 735 that is assembled into the L-shaped insulated housing perimeter and disposed between the L-shaped, insulated housing 731 and the inner top wall 603', the inner back wall 103", and the inner side wall 603'" of the fresh food compartment 603, and a housing collar 736 that is disposed on an open front portion of the L-shaped, insulated housing 731 (see FIG. 17). The housing collar 736 has an opening 736' therein for receiving the ice bucket 751. The gasket 735 may be molded silicone or ethylene propylene diene monomer (EPDM) or an extruded gasket formed from, for example, polyvinyl chloride (PVC) and that is inserted into a channel that is formed along the edge of the L-shaped, insulated housing 731 and held in place by plastic clips (not shown). Moreover, an L-shaped bracket 737 for fastening the L-shaped, insulated housing 731 to the inner top wall 603' of the fresh food compartment 603 is fastened to the front of the L-shaped, insulated housing 731 by suitable fasteners. The housing collar 736 has a plurality of locking tabs 736A for mounting the housing collar 736 to the L-shaped bracket 737 and in turn the open front portion of the L-shaped, insulated housing 731 (see FIG. 17). With such a construction, the L-shaped, insulated housing 731 is positioned in the upper left hand corner of the fresh food compartment 603 and over the ice maker assembly 710 and then held in place by suitable fasteners. A vertically projecting wall 738 is formed on the end of the horizontal portion of the outer wall 732 of the L-shaped, insulated housing 731 and can be used to engage with a step portion (not shown) on the inner side wall 603'" of the fresh food compartment 603 of the refrigerator 600.

Figure 23A:
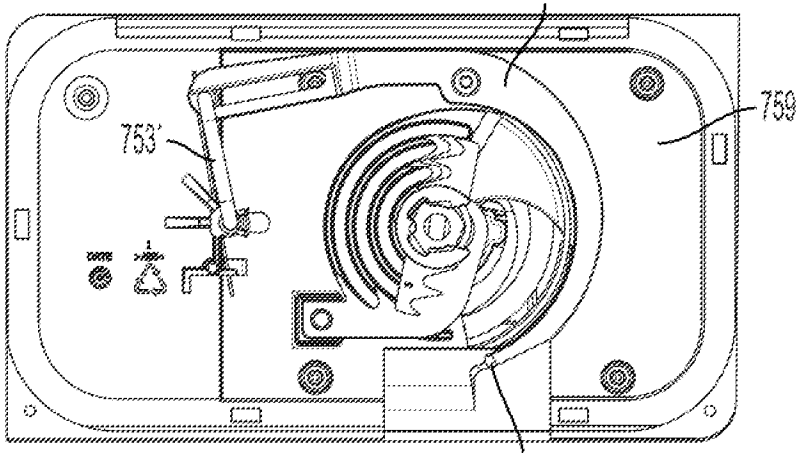
Figure 23B:
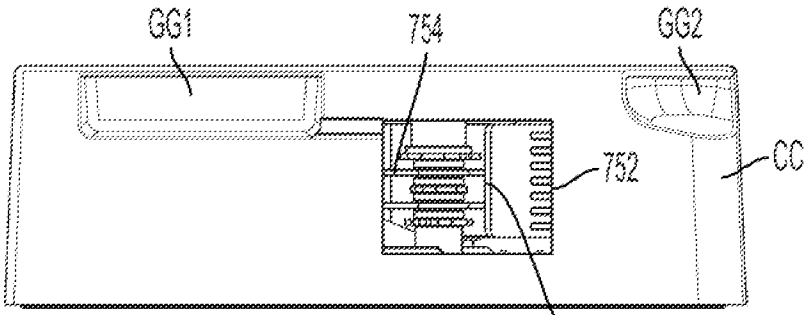
Figure 23C:
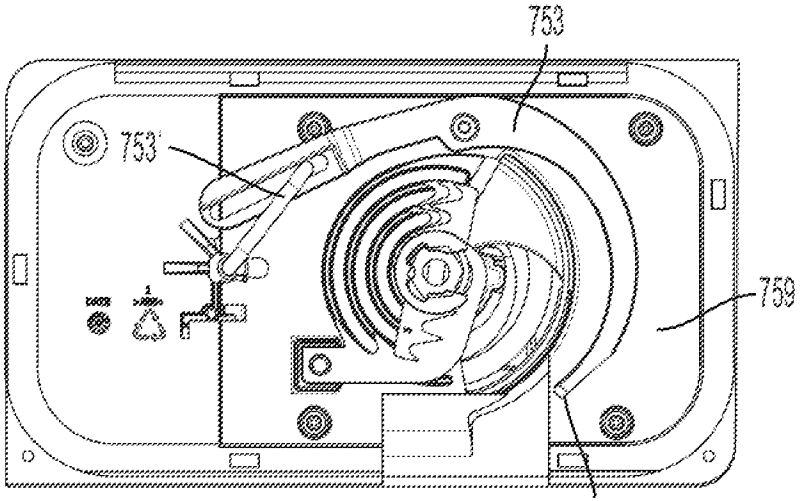

With reference to FIGS. 14, 16A, 22A, 22B, and 23A-23D, the cube/crush motor assembly 740 is disposed within the ice compartment housing assembly 730 at a location in front of the ice maker assembly 710 and is mounted, for example, to a back wall of the housing collar 736 or similar. The cube/crush motor assembly 740 is used to control whether cubed or crushed ice is delivered to the user. More specifically, the ice bucket assembly 750 has an ice bucket outlet opening 752 (seen from bottom in FIGS. 23B and 23D) in a front cover CC through which ice pieces are delivered, as will be described in more detail below. As shown in FIGS. 23A and 23C, the ice bucket outlet opening 752 has an ice gate 753 that is pivotally mounted on wall 759 and pivots, such that the ice gate 753 opens or closes. When the ice gate 753 is closed (see FIGS. 23A and 23B), it forces the ice pieces, such as in the shape of cubes, towards a plurality of crushing blades 754 (for example, when "crushed" ice is selected by the user). On the other hand, when "cubed" ice is selected by the user, the ice gate 753 opens (see FIGS. 23C and 23D) thus allowing the ice cubes to come out through the ice bucket outlet opening 752 missing the crushing blades. The default position for the ice gate 753 is closed, and this minimizes any ice cubes from falling out through the ice bucket opening 752 when the user pulls out the ice bucket assembly 750. This also prevents the user from touching the blades while pulling out the ice bucket assembly 750. The pivoting of the ice gate 753 is carried out by a rod 753' (see FIGS. 23A and 23C) that engages into an actuator head that is controlled by a cube/crush motor 755 (for example, a synchronous electric motor) that moves the actuator head up (opening the ice gate 753) and moves the actuator head down (closing the ice gate 753—default position). The rod 753' passes through an opening 758' in the housing collar 736 (see FIG. 14). The ice bucket assembly 750 has a magnet 758 disposed in the ice bucket 751 (see FIG. 15A) and that interfaces with a Hall effect switch 755A (see FIG. 15A) that is disposed inside of the gear box 718 of ice maker assembly 710. The front of the cube/crush motor 755 includes a housing hopper flap 755B. An electrical connector 760 for connecting cube/crush motor 755 to a corresponding connector for supplying power extends from wiring 761 off the back of the cube/crush motor 755 (see FIGS. 14, 22A, and 22B). Accordingly, when the ice bucket 751 with front cover CC is removed from the opening 736' in the housing collar 736 of the ice compartment 700, the Hall effect switch 755A opens the circuit thereby disabling: any ice dispensing, the ice maker 711, and the electric motor driven fan 722. This in turn prevents any ice harvesting while the ice bucket 751 is not present, and also minimizes moisture ingress inside the ice compartment 700. Once the ice bucket assembly 750 is placed back into the ice compartment housing assembly 730, the normal operation is resumed.

With reference to FIGS. 14, 15A, 16A, 23B, and 23D, the ice bucket assembly 750 includes the ice bucket or bin 751 for storing ice pieces and in which the auger member 726 is disposed, and the front cover CC. As noted above, the ice bucket 751 is removably mounted in the slimline ice compartment 700. An inner side wall of the ice bucket 751 can be formed with a recessed portion 751A (see FIG. 14) across the bottom front of the ice bucket 751 in order to facilitate air flow into a front end portion PP1 of the airflow passage PP, so that the air that has cooled the ice can exit the ice bucket 751 and enter at the front end portion PP1 of the airflow passage PP under the integral ice maker assembly unit 712 to be cooled again (see FIGS. 18, 19A, and 19B). As with the first embodiment, the ice bucket 751 can also be formed with a plurality of through-holes or slots in the inner side wall which allow the air that has cooled the ice to exit the ice bucket 751. As noted above, the front cover CC has the ice bucket outlet opening 752 on the bottom through which ice pieces are delivered when a user dispenses ice pieces. The ice bucket outlet opening 752 cooperates with the opening 607 (see FIG. 13) of the dispenser ice chute to deliver ice pieces to the dispenser when the door 604 is in a closed position. The interface between the ice bucket outlet opening 752 and the opening 607 in the top of the dispenser ice chute can be sealed with a gasket, have a partial or open gasket, or have no gasket at all. In the latter two cases, some air is permitted to move between the fresh food compartment 603 and the ice compartment 700 by moving into the region inside the dispenser ice chute and through the ice bucket outlet opening 752 and into the ice compartment 700 and vice versa.

Figure 23D:
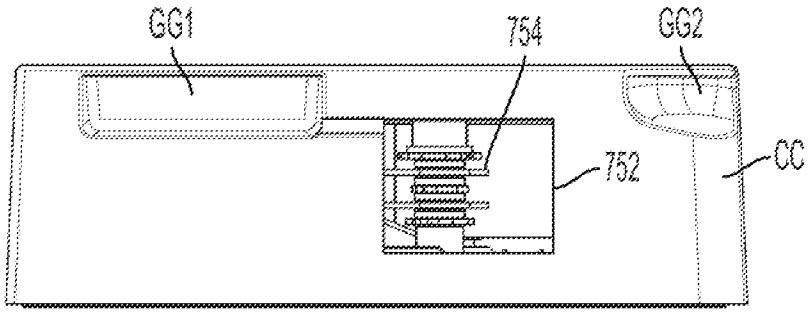

FIGS. 23B and 23D show that the bottom of the front cover CC also includes gripper recesses GG1 and GG2 (see also FIG. 14) for the user to insert their fingers to pull and remove the ice bucket 751 or return the same into position. The hollow inside of the front cover CC includes insulation IC (see FIG. 16A), and the insulation may entirely fill the inside of the front cover CC. Alternatively, the lower region around the ice bucket outlet opening 752 may be free of any insulation.

In operation and during the ice making mode in the second embodiment, the refrigerant valve 511 (reference is again made to FIG. 10 of the first embodiment as the operation of the second embodiment is substantially the same, with elements designated with the reference numerals beginning with a "6" and "7" of the second embodiment corresponding to the same elements beginning with a "1" and "2", respectively, of the first embodiment) directs the refrigerant gas through the cooling tube 713 which directly contacts the ice tray 712A. A water fill valve (not shown) that is located in the water fill tube WT that connects to the connection WWF (see FIGS. 20A and 20B) is opened in order to fill the cavities 712' with water and then is closed after a predetermined period of time (e.g., 5 seconds) has elapsed. Once the water in the individual cavities 712' is frozen, which is determined by the thermistor TT that continuously senses the integral ice maker assembly unit 712 up to a predefined temperature, the refrigerant valve 511 bypasses or diverts the refrigerant gas to, for example, the freezer evaporator 504 and then the defrost heater DDH is turned "ON". Once a predetermined temperature is reached, the defrost heater DDH is turned "OFF" and the ejector plates 716 are rotated by the shaft 716' to scoop out the ice pieces (for example, ice cubes) from the tray cavities 712'. After a complete turn of 360 degrees of the ejector plates, the cycle is restarted with water by the water fill valve (see connection WWF for a water fill tube WT in FIGS. 20A and 20B) filling the cavities 712' and the refrigerant valve 511 redirecting the refrigerant to the cooling tube 713 assembled inside of the integral ice maker assembly unit 712. It is noted that between cycles the ice level is checked in order to determine whether the ice maker will continue making ice or instead go into a "full" ice bucket mode.

The present invention has substantial opportunity for variation without departing from the spirit or scope of the present invention. For example, while FIGS. 1 and 13 show a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Also, while the slimline ice compartment is shown in the fresh food compartment, the slimline ice compartment could be disposed in a freezer compartment. Still further, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:

a fresh food compartment;

an ice compartment disposed in the fresh food compartment;

an ice maker disposed in the ice compartment, the ice maker including an ice maker tray, a separate fin evaporator, and a cooling tube at least a portion of which is assembled between the ice maker tray and the fin evaporator, such that the cooling tube is in direct contact with the ice maker tray and the fin evaporator; and an ice bucket for storing ice, the ice bucket being disposed in the ice compartment.

2. The refrigerator of claim 1, wherein the ice maker and the ice bucket are arranged side-by-side in a horizontal direction within the ice compartment, and wherein no portion of the ice bucket is located below the ice maker when the ice maker is projected downward in a vertical height direction.

3. The refrigerator of claim1, further comprising a sensor to sense an amount of ice in the ice bucket.

4. The refrigerator of claim 1, wherein the ice compartment is disposed in an upper corner of the fresh food compartment.

5. The refrigerator of claim 1, wherein the refrigerator is a French door-bottom mount configuration having the fresh food compartment on top and the freezer compartment below the fresh food compartment.

6. The refrigerator of claim 5, wherein the ice compartment is disposed in an upper left hand corner of the fresh food compartment.

7. The refrigerator of claim 1, wherein the ice bucket is removably mounted in the ice compartment.

8. The refrigerator of claim 1, wherein the ice compartment has a thin dimension in a vertical height direction H of approximately 5.6 inches±2.0 inches, and wherein the ice compartment has a horizontal width W of approximately 10.4 inches±2.0 inches.

9. The refrigerator of claim 1, wherein the ice bucket has an opening in a bottom portion for discharging pieces of ice.

10. The refrigerator of claim 1, wherein the cooling tube is formed of at least one of copper or a copper alloy.

11. The refrigerator of claim 1, wherein the ice maker tray is formed of at least one of aluminum or an aluminum alloy.

12. The refrigerator of claim 1, wherein the fin evaporator includes at least one fin that extends downward substantially vertically.

13. The refrigerator of claim 1, further comprising an air handler/auger motor assembly disposed at a rear portion of the ice compartment behind the ice bucket.

14. The refrigerator of claim 13, wherein the air handler/auger motor assembly comprises an air duct having a motor driven fan disposed therein, wherein an inlet of the motor driven fan communicates with an airflow passage under the ice maker tray and fin evaporator, such that the motor driven fan creates a suction and draws cool air from the ice maker tray and the fin evaporator and discharges the cool air through the air duct and to the ice bucket to prevent any ice pieces in the ice bucket from melting.

15. The refrigerator of claim 14, wherein the air duct is located at an upper portion of the air handler/auger motor assembly.

16. The refrigerator of claim 15, further comprising an ice compartment air duct member that communicates with an outlet of the air duct and is configured to direct and distribute the cool air over the ice pieces in the ice bucket and around the ice bucket.

17. The refrigerator of claim 1, wherein the ice bucket is removably mounted in the ice compartment, and the ice bucket has a front cover with an opening in a bottom portion for discharging pieces of ice; and further comprising:

a cube/crush motor assembly including a cube/crush motor and a detector and being disposed in the ice compartment at a location in front of the ice maker and being configured to control whether cubed or crushed ice is delivered to the opening in the front cover, wherein the ice bucket has a member that interfaces with the detector, such that on condition that the ice bucket with front cover is removed from the ice compartment, the detector disables the ice maker.

18. The refrigerator of claim 17, wherein the opening has an ice gate that pivots, such that the ice gate opens or closes, and wherein the pivoting of the ice gate is carried out by a rod that is controlled by the cube/crush motor.

19. The refrigerator of claim 1, further comprising a drain assembly positioned under the fin evaporator, wherein the ice bucket is arranged side-by-side with the ice maker and the drain assembly in a horizontal direction within the ice compartment, such that a bottom portion of the ice bucket is located at substantially the same level as a bottom portion of the drain assembly in a vertical height direction.

20. The refrigerator of claim 19, wherein the drain assembly cooperates with a bottom portion of the fin evaporator to form an airflow passage under the ice maker and through evaporator fins of the fin evaporator.

21. The refrigerator of claim 19, wherein the drain assembly comprises a drain housing, drain insulation, and a drain plate.

22. The refrigerator of claim 19, further comprising a heater plate and an extender housing.

23. The refrigerator of claim 22, wherein the heater plate is formed of aluminum.

24. The refrigerator of claim 22, wherein the heater plate and the extender housing transfer heat from a defrost heater into a drain hole.

25. The refrigerator of claim 20, wherein an inner side wall of the ice bucket is formed with a recessed portion across a bottom front of the ice bucket in order to facilitate air flow into a front end portion of the airflow passage.

26. The refrigerator of claim 17, wherein the bottom portion of the front cover includes at least one gripper recess for a user to insert their fingers to pull and remove the ice bucket.

27. A refrigerator comprising:

a fresh food compartment;

an ice compartment disposed in the fresh food compartment;

an ice maker disposed in the ice compartment, the ice maker including an ice maker tray and an evaporator cooling tube which is embedded in the ice maker tray, such that the evaporator cooling tube is in direct contact with the ice maker tray and an evaporator;

an ice bucket for storing ice, the ice bucket being disposed in the ice compartment; and a refrigerant circuit including a bypass line with a refrigerant valve which is located prior to an inlet of the evaporator cooling tube in order to bypass the evaporator cooling tube and communicate a refrigerant to a further evaporator, wherein during ice making, the refrigerant valve directs the refrigerant through the evaporator cooling tube that is in direct contact with the at least one outer surface of the ice maker tray.

28. A refrigerator comprising:

a fresh food compartment;

an ice compartment disposed in the fresh food compartment;

an ice maker disposed in the ice compartment, the ice maker including an ice maker tray, an evaporator cooling tube, and a separate evaporator cooling tube holder, at least a portion of the evaporator cooling tube being assembled between the ice maker tray and the separate evaporator cooling tube holder, such that the evaporator cooling tube is in direct contact with the ice maker tray and the separate evaporator cooling tube holder, with at least one fin extending from at least one of the ice maker tray and the separate evaporator cooling tube holder; and an ice bucket for storing ice, the ice bucket being disposed in the ice compartment.

29. A refrigerator comprising:

a fresh food compartment;

an ice compartment disposed in the fresh food compartment;

an ice maker disposed in the ice compartment, the ice maker including an ice maker tray, an evaporator cooling tube, and at least one fin extending from the ice maker tray, wherein the evaporator cooling tube is embedded in the ice maker tray, such that the evaporator cooling tube is in direct contact with the ice maker tray and an evaporator; and an ice bucket for storing ice, the ice bucket being disposed in the ice compartment.

* * * * *